US008205270B2

(12) United States Patent
Kato

(10) Patent No.: US 8,205,270 B2
(45) Date of Patent: Jun. 26, 2012

(54) GARMENT HAVING A WAIST SIZE ADJUSTING MECHANISM

(76) Inventor: Koji Kato, Hashima (JP)

( * ) Notice: Subject to any disclaimer, the term of this patent is extended or adjusted under 35 U.S.C. 154(b) by 578 days.

(21) Appl. No.: 11/464,897

(22) Filed: Aug. 16, 2006

(65) Prior Publication Data

US 2008/0040833 A1 Feb. 21, 2008

(51) Int. Cl.

| | |
|---|---|
| ***A41D 1/06*** | (2006.01) |
| ***A41D 13/02*** | (2006.01) |
| ***A41D 1/14*** | (2006.01) |
| ***A41F 9/00*** | (2006.01) |
| ***A41B 9/14*** | (2006.01) |

(52) U.S. Cl. ..... 2/237; 2/76; 2/221

(58) Field of Classification Search ..... 2/76, 128, 2/307, 237, 221, 236, 220

See application file for complete search history.

(56) References Cited

U.S. PATENT DOCUMENTS

| | | | | |
|---|---|---|---|---|
| 1,814,760 | A * | 7/1931 | Miller, Jr. | 2/265 |
| 3,263,290 | A * | 8/1966 | Eguchi et al. | 24/662 |
| 2005/0022287 | A1 * | 2/2005 | Neff et al. | 2/129 |
| 2005/0125876 | A1 * | 6/2005 | Kato | 2/129 |
| 2005/0210561 | A1 * | 9/2005 | Robinson | 2/129 |
| 2005/0251891 | A1 * | 11/2005 | Keeter | 2/129 |

FOREIGN PATENT DOCUMENTS

JP 2002-339113 A 11/2002

* cited by examiner

*Primary Examiner* — Alissa L Hoey
*Assistant Examiner* — Amber Anderson
(74) *Attorney, Agent, or Firm* — Westerman, Hattori, Daniels & Adrian, LLP

(57) ABSTRACT

Ladies' pants has an inside belt portion that is provided with an eyelet buttonhole as a second buttonhole. A moving cloth is provided inside the inside belt portion. A button is sewn on the moving cloth and is taken out from the eyelet buttonhole so as to be movable inside the eyelet buttonhole. If the button is engaged with the second buttonhole, the eyelet buttonhole is hidden under an outside belt portion. Then, the ladies' pants allows a waist size to continuously change, thereby giving a wearer a relaxed and comfortable wearing feeling. A round part of the eyelet buttonhole is located at a position corresponding to nearly a center of the moving cloth when the moving cloth returns to its original position. Then, even if the button is detached, the button can be stitched by scoop sewing through the round part of the eyelet buttonhole. Thus, the button can be surely reattached to the moving cloth.

9 Claims, 20 Drawing Sheets

GARMENT HAVING A WAIST SIZE ADJUSTING MECHANISM

BACKGROUND OF THE INVENTION

1. Field of the Invention

This invention relates to a garment having a waist size adjusting mechanism that is attached with a button for jointing a parted portion of a waist in a garment such as pants and a skirt. Particularly, the invention relates to a garment having a waist adjusting mechanism that can adjust a waist size according to a waist of a user. The invention is applicable to, for instance, pants having a waist adjusting mechanism, a skirt having a waist adjusting mechanism and so on. The invention is applicable to any type of garment in general.

2. Description of the Related Art

The inventor of the present application has previously filed a patent application for an invention of a garment or clothes having a waist size adjusting mechanism: Japanese Laid Open Patent Publication No. 2002-339113. The inventive garment can adjust a waist size according to a waist size of a user. Moreover, the inventive garment never impairs a wearing feeling or an appearance (good-looking) even if not only the waist size but also a size around the waist of the user changes to a certain degree. The invention is applicable to pants or trousers, skirts, etc. The garment can use a button, a dot button and so on as a fastener. A wearer can easily select a state in which a waist size is continuously changed and a state in which the waist size is fixed in the garment having the waist size adjusting structure.

A center tab is attached to an inside belt portion of a waistband of the pants or trousers via a rubber tape in the garment having the waist size adjusting mechanism according to the previous invention. The inside belt portion means an inner fold (fold or layer located at an inside) of the waistband of the garment that has an end part overlapped and masked by an outer fold of the waistband, i.e. a right fold or right belt portion of the waistband in case of embodiment of the above publication. The rubber tape is covered and masked by an over belt. A button, a dot button (male or female part) or the like is attached to the center tab that is movable along the waistband direction (in a waist direction). A buttonhole, a counterpart dot button (female or male part) or the like is provided on a corresponding position of an outside belt portion (an outer fold or outer layer located at an outside of the waistband) of the waistband. Moreover, a button, a dot button or the like is directly attached to the inside belt portion of the waistband. Thus, when the button or the dot button of the center tab is fitted in the buttonhole or the counterpart dot button of the outside belt portion of the waistband, the waist becomes a free size (the changeable state) within a range in which the rubber tape is extensible. Consequently, a loose and comfortable wearing feeling is achieved. On the other hand, when the button or the dot button directly attached to the inside belt portion of the waistband is fitted in the buttonhole or the counterpart dot button of the outside belt portion of the waistband, the waist size becomes the fixed state.

However, extra parts or component such as the center tab and the over belt are seen from outside in the invention of the publication No. 2002-339113. As a result, there is a problem that an appearance is not so attractive and some users or wearers feel the good appearance spoiled.

SUMMARY OF THE INVENTION

An object of the present invention is to provide a garment having a waist size adjusting mechanism that enables a wearer to change a waist size continuously, while having the same look as common pants (trousers), that enables the wearer to easily select a first state in which the waist size is continuously changeable and a second state in which the waist size is fixed and that enables the wearer to reattach a button when the button is detached.

According to a first aspect of the invention, there is provided a garment having a waist size adjusting mechanism. In the garment, a coupling device joins one and another parts of a garment in a separable way and making a waist size of the garment adjustable within a predetermined range. A tuck is provided on an outer fold of the garment so as to extend generally in a vertical direction. The tuck is capable of changing its shape within such a range as the coupling device makes the waist size of the garment adjustable. A fastener has a first fastener tape and a second fastener tape. The first fastener tape as a seam allowance is sewn on the tuck provided on the outer fold of the garment. The second fastener tape as a seam allowance is sewn on an inner fold of the garment. A moving cloth of a predetermined length is attached to an inside belt portion of the garment via an elastic material so as to be movable along a waistband. A button is stitched on the moving cloth with a predetermined length of a thread base or a neck-wrapping made of a thread firmly wound and fixed around the thread base. A second buttonhole is provided on a front fabric of the inside belt portion of the garment, the button being passed through the second buttonhole from a rear side to a front side, the button being movable in accordance with the moving cloth as the moving cloth moves along the waistband against an elastic force of the elastic material. The second buttonhole is an eyelet buttonhole having a round part provided at one longitudinal end away from the outer fold of the garment. The round part of the second buttonhole is located at a position corresponding to nearly a center of the moving cloth when the moving cloth returns to an original position by the elastic force of the elastic material. An upper end of the first fastener tape is stitched to an upper end of the outer fold of the garment via a sliding tape and a rubber tape. The sliding tape is stitched in an inclined manner toward an outside. The coupling device includes the button that is stitched to the moving cloth and that is taken out to the front side through the second buttonhole and a buttonhole that is provided on an outside belt portion of the garment.

According to the first aspect of the invention, the tuck is provided on the outer fold of trousers or the like on which the fastener tapes are stitched so that the fastener tapes is allowed to move in accordance with a change of the waist size. The button is stitched on the moving cloth having the predetermined length that is attached to the inside belt portion of the garment via the elastic material so as to be movable along the waistband or in a waist direction. The button is protruded or taken out to the front side from the second buttonhole of the eyelet buttonhole shape that is provided on the front fabric of the inside belt portion. Then, the button is engaged in the buttonhole provided on the outside belt portion. Thus, the waist size becomes a free size since the button moves inside the second buttonhole within a range in which the elastic material can stretch. Accordingly, the garment gives a wearer a comfortable wear feeling. Moreover, the second buttonhole of the eyelet buttonhole shape is hidden when the button is engaged with the buttonhole of the outside belt portion. Thereby, the garment having the waist size adjusting mechanism has completely the same appearance as a normal garment. In addition, the fastener tape moves in accordance with the change of the waist size, so that there are no wrinkles or the like generated around the waist.

The upper end of the first fastener tape is stitched to the upper end of the outer fold of the garment via the sliding tape and the rubber tape at an inside of a back fabric of the outside belt portion. The sliding tape is held and stitched inside the outside belt portion in the inclined manner toward the outside of the edge of the outer fold. The outside belt portion is provided with the buttonhole 6 that is buttonholed. The buttonhole passes through part of the sliding tape and the rubber tape that are attached inside the outside belt portion. The sliding tape and the rubber tape are also stitched by the buttonholing of the buttonhole. However, in the garment having the waist size adjusting mechanism of the invention, the first fastener tape is supported not only by the sliding tape but also by the rubber tape. Consequently, the first fastener tape can also move in accordance with a extension of the tuck by a stretching force of the rubber tape when the folded/overlapped portion of the tuck is extended. Thus, the first fastener tape is never hindered from moving even if the outside belt portion is provided with the buttonhole and the buttonhole is buttonholed.

Moreover, the second buttonhole is made of the eyelet buttonhole that has the round part provided at the end at the far side away from the outer fold of the garment. The round part of the second buttonhole is located at a position corresponding to around the center of the moving cloth when the moving cloth returns to the original position by the elastic force of the elastic material. Thereby, the button can be attached by scoop sewing through the round part of the second buttonhole. That is, the button can be easily reattached to around the center of the moving cloth even when the button is detached and comes off. Consequently, there is no need to seek a position to reattach the button in case the button is detached, so that the button is easily reattached without complicated work and labor.

As described above, the garment having the waist size adjusting mechanism has the same appearance as the ordinary garment and is able to continuously change the waist size while keeping the improved appearance. In addition, when the button comes off, the button is enabled to be easily reattached.

According to a second aspect of the invention, there is provided a garment having a waist size adjusting mechanism. In the garment, a coupling device joins one and another parts of a garment in a separable way and making a waist size of the garment adjustable within a predetermined range. A tuck is provided on an outer fold of the garment so as to extend generally in a vertical direction. The tuck is capable of changing its shape within such a range as the coupling device makes the waist size of the garment adjustable. A fastener has a first fastener tape and a second fastener tape. The first fastener tape as a seam allowance is sewn on the tuck provided on the outer fold of the garment. The second fastener tape as a seam allowance is sewn on an inner fold of the garment. A moving cloth of a predetermined length is attached to an inside belt portion of the garment via an elastic material so as to be movable along a waistband. A button is stitched on the moving cloth with a predetermined length of a thread base or a neck-wrapping. A second buttonhole is provided on a front fabric of the inside belt portion of the garment. The button is passed through the second buttonhole from a rear side to a front side. The button is movable in accordance with the moving cloth as the moving cloth moves along the waistband against an elastic force of the elastic material. The second buttonhole is an eyelet buttonhole having a round part provided at one longitudinal end away from the outer fold of the garment. The round part of the second buttonhole is located at a position corresponding to nearly a center of the moving cloth when the moving cloth returns to an original position by the elastic force of the elastic material. An upper end part of the first fastener tape is stitched in an inclined manner toward an outside. The coupling device includes the button that is stitched to the moving cloth and that is taken out to the front side through the second buttonhole and a buttonhole that is provided on an outside belt portion of the garment.

According to the second aspect of the invention, the tuck is provided on the outer fold of trousers or the like on which the fastener tapes are stitched so that the fastener tapes is allowed to move in accordance with a change of the waist size. The button is stitched on the moving cloth having the predetermined length that is attached to the inside belt portion of the garment via the elastic material so as to be movable along the waistband or in a waist direction. The button is protruded or taken out to the front side from the second buttonhole of the eyelet buttonhole shape that is provided on the front fabric of the inside belt portion. Then, the button is engaged in the buttonhole provided on the outside belt portion. Thus, the waist size becomes a free size since the button moves inside the second buttonhole within a range in which the elastic material can stretch. Accordingly, the garment gives a wearer a comfortable wear feeling. Moreover, the second buttonhole of the eyelet buttonhole shape is hidden when the button is engaged with the buttonhole of the outside belt portion. Thereby, the garment having the waist size adjusting mechanism has completely the same appearance as a normal garment. In addition, the fastener tape moves in accordance with the change of the waist size, so that there are no wrinkles or the like generated around the waist.

The upper end of the first fastener tape is stitched in an inclined manner toward the outside. Therefore, the first fastener tape can also move in accordance with an extension of the tuck when the folded/overlapped portion of the tuck is extended. In addition, since the sliding tape is not provided, the first fastener tape is not hindered from moving even if the buttonhole is provided at the outside belt portion and is buttonholed.

Moreover, the second buttonhole is made of the eyelet buttonhole that has the round part provided at the end at the far side away from the outer fold of the garment. The round part of the second buttonhole is located at a position corresponding to around the center of the moving cloth when the moving cloth returns to the original position by the elastic force of the elastic material. Thereby, the button can be attached by scoop sewing through the round part of the second buttonhole. That is, the button can be easily reattached to around the center of the moving cloth even when the button is detached and comes off. Consequently, there is no need to seek a position to reattach the button in case the button is detached, so that the button is easily reattached without complicated work and labor.

As described above, the garment having the waist size adjusting mechanism has the same appearance as the ordinary garment and is able to continuously change the waist size while keeping the improved appearance. In addition, when the button comes off, the button is enabled to be easily reattached.

According to a third aspect of the invention, there is provided a garment having a waist size adjusting mechanism. In the garment, a coupling device joins one and another parts of a garment in a separable way and making a waist size of the garment adjustable within a predetermined range. An adjusting cloth of generally a tubular shape is sewn on an outer fold of the garment so as to extend generally in a vertical direction. The adjusting cloth is capable of changing its shape within such a range as the coupling device makes the waist size of the garment adjustable. A moving cloth of a predetermined length is attached to an inside belt portion of the garment via an elastic material so as to be movable along a waistband. A button is stitched on the moving cloth with a predetermined length of a thread base or a neck-wrapping. A second buttonhole is provided on a front fabric of the inside belt portion of the garment. The button is passed through the second buttonhole from a rear side to a front side. The button is movable in accordance with the moving cloth as the moving cloth moves along the waistband against an elastic force of the elastic material. A fastener has a first fastener tape and a second fastener tape. The first fastener tape as a seam allowance is sewn on the adjusting cloth sewn on the outer fold of the garment. The second fastener tape as a seam allowance is sewn on an inner fold of the garment. The second buttonhole is an eyelet buttonhole having a round part provided at one longitudinal end away from the outer fold of the garment. The round part of the second buttonhole is located at a position corresponding to nearly a center of the moving cloth when the moving cloth returns to an original position by the elastic force of the elastic material. An upper end part of the first fastener tape is stitched in an inclined manner toward an outside. The coupling device includes the button that is stitched to the moving cloth and that is taken out to the front side through the second buttonhole and a buttonhole that is provided on an outside belt portion of the garment.

According to the third aspect of the invention, the adjusting cloth of generally the tubular shape is stitched to the outer fold of trousers or the like on which the fastener tapes are stitched so that the fastener tapes is allowed to move in accordance with a change of the waist size. The button is stitched on the moving cloth having the predetermined length that is attached to the inside belt portion of the garment via the elastic material so as to be movable along the waistband or in a waist direction. The button is protruded or taken out to the front side from the second buttonhole of the eyelet buttonhole shape that is provided on the front fabric of the inside belt portion. Then, the button is engaged in the buttonhole provided on the outside belt portion. Thus, the waist size becomes a free size since the button moves inside the second buttonhole within a range in which the elastic material can stretch. Accordingly, the garment gives a wearer a comfortable wear feeling. Moreover, the second buttonhole of the eyelet buttonhole shape is hidden when the button is engaged with the buttonhole of the outside belt portion. Thereby, the garment having the waist size adjusting mechanism has completely the same appearance as a normal garment. In addition, the fastener tape moves in accordance with the change of the waist size, so that there are no wrinkles or the like generated around the waist.

The upper end of the first fastener tape is stitched in an inclined manner toward the outside. Therefore, the first fastener tape can also move in accordance with a deformation of the adjusting cloth when the adjusting cloth of generally the tubular shape is deformed. In addition, since the sliding tape is not provided, the first fastener tape is not hindered from moving even if the buttonhole is provided at the outside belt portion and is buttonholed.

Moreover, the second buttonhole is made of the eyelet buttonhole that has the round part provided at the end at the far side away from the outer fold of the garment. The round part of the second buttonhole is located at a position corresponding to around the center of the moving cloth when the moving cloth returns to the original position by the elastic force of the elastic material. Thereby, the button can be attached by scoop sewing through the round part of the second buttonhole. That is, the button can be easily reattached to around the center of the moving cloth even when the button is detached and comes off. Consequently, there is no need to seek a position to reattach the button in case the button is detached, so that the button is easily reattached without complicated work and labor.

As described above, the garment having the waist size adjusting mechanism has the same appearance as the ordinary garment and is able to continuously change the waist size while keeping the improved appearance. In addition, when the button comes off, the button is enabled to be easily reattached.

According to a fourth aspect of the invention, there is provided a garment having a waist size adjusting mechanism. In the garment, a coupling device joins one and another parts of a garment in a separable way and making a waist size of the garment adjustable within a predetermined range. A moving cloth of a predetermined length is attached to an inside belt portion of the garment via an elastic material so as to be movable along a waistband. A button is stitched on the moving cloth with a predetermined length of a thread base or a neck-wrapping. A second buttonhole is provided on a front fabric of the inside belt portion of the garment, the button being passed through the second buttonhole from a rear side to a front side. The button is movable in accordance with the moving cloth as the moving cloth moves along the waistband against an elastic force of the elastic material. The second buttonhole is an eyelet buttonhole having a round part provided at one longitudinal end away from the outer fold of the garment. The round part of the second buttonhole is located at a position corresponding to nearly a center of the moving cloth when the moving cloth returns to an original position by the elastic force of the elastic material. The coupling device includes the button that is stitched to the moving cloth and that is taken out to the front side through the second buttonhole and a buttonhole that is provided on an outside belt portion of the garment.

According to the fourth aspect of the invention, the button is stitched on the moving cloth having the predetermined length that is attached to the inside belt portion of the garment via the elastic material so as to be movable along the waistband or in a waist direction. The button is protruded or taken out to the front side from the second buttonhole of the eyelet buttonhole shape that is provided on the front fabric of the inside belt portion. Then, the button is engaged in the buttonhole provided on the outside belt portion. Thus, the waist size becomes a free size since the button moves inside the second buttonhole within a range in which the elastic material can stretch. Accordingly, the garment gives a wearer a comfortable wear feeling. Moreover, the second buttonhole of the eyelet buttonhole shape is hidden when the button is engaged with the buttonhole of the outside belt portion. Thereby, the garment having the waist size adjusting mechanism has completely the same appearance as a normal garment.

Moreover, the second buttonhole is made of the eyelet buttonhole that has the round part provided at the end at the far side away from the outer fold of the garment. The round part of the second buttonhole is located at a position corresponding to around the center of the moving cloth when the moving cloth returns to the original position by the elastic force of the elastic material. Thereby, the button can be attached by scoop sewing through the round part of the second buttonhole. That is, the button can be easily reattached to around the center of the moving cloth even when the button is detached and comes off. Consequently, there is no need to seek a position to reattach the button in case the button is detached, so that the button is easily reattached without complicated work and labor.

As described above, the garment having the waist size adjusting mechanism has the same appearance as the ordinary garment and is able to continuously change the waist size while keeping the improved appearance. In addition, when the button comes off, the button is enabled to be easily reattached.

According to a fifth aspect of the invention, any one of the above garments may further comprise an inside belt facing of the garment having a stitched round hole or a ring hole as a through hole provided at a position corresponding to the round part of the eyelet buttonhole as the second buttonhole.

According to the fifth aspect of the invention, the stitched round hole or the ring hole as the through hole is provided on the inside belt facing of the garment at the position corresponding to the round part of the eyelet buttonhole as the second buttonhole.

Thereby, even if the button comes off, the button can be reattached by passing a needle through the round part of the second buttonhole by use of the stitched round hole or the ring hole as the through-hole as a guide, since it is located at the position corresponding to the round part of the eyelet buttonhole. Therefore, the button is easier to be stitched and attached more durably.

As described above, the garment having the waist size adjusting mechanism has the same appearance as the ordinary garment and is able to continuously change the waist size while keeping the improved appearance. In addition, when the button comes off, the button is enabled to be more easily reattached with durability.

According to a sixth aspect of the invention, there is provided a garment having a waist size adjusting mechanism. In the garment, a coupling device joins one and another parts of a garment in a separable way and making a waist size of the garment adjustable within a predetermined range. A tuck is provided on an outer fold of the garment so as to extend generally in a vertical direction. The tuck is capable of changing its shape within such a range as the coupling device makes the waist size of the garment adjustable. A fastener has a first fastener tape and a second fastener tape. The first fastener tape as a seam allowance is sewn on the tuck provided on the outer fold of the garment. The second fastener tape as a seam allowance is sewn on an inner fold of the garment. A moving cloth of a predetermined length is attached to an inside belt portion of the garment via an elastic material so as to be movable along a waistband. A button is stitched on the moving cloth with a predetermined length of a thread base or a neck-wrapping. A second buttonhole is provided on a front fabric of the inside belt portion of the garment. The button is passed through the second buttonhole from a rear side to a front side. The button is movable in accordance with the moving cloth as the moving cloth moves along the waistband against an elastic force of the elastic material. An inside belt facing of the garment has a stitched round hole or a ring hole as a through hole provided at a position corresponding to nearly a center of the moving cloth when the moving cloth returns to an original position by the elastic force of the elastic material. An upper end of the first fastener tape is stitched to an upper end of the outer fold of the garment via a sliding tape and a rubber tape. The sliding tape is stitched in an inclined manner toward an outside. The coupling device includes the button that is stitched to the moving cloth and that is taken out to the front side through the second buttonhole and a buttonhole that is provided on an outside belt portion of the garment.

According to the sixth aspect of the invention, the tuck is provided on the outer fold of trousers or the like on which the fastener tapes are stitched so that the fastener tapes is allowed to move in accordance with a change of the waist size. The button is stitched on the moving cloth having the predetermined length that is attached to the inside belt portion of the garment via the elastic material so as to be movable along the waistband or in a waist direction. The button is protruded or taken out to the front side from the second buttonhole that is provided on the front fabric of the inside belt portion. Then, the button is engaged in the buttonhole provided on the outside belt portion. Thus, the waist size becomes a free size since the button moves inside the second buttonhole within a range in which the elastic material can stretch. Accordingly, the garment gives a wearer a comfortable wear feeling. Moreover, the second buttonhole is hidden when the button is engaged with the buttonhole of the outside belt portion. Thereby, the garment having the waist size adjusting mechanism has completely the same appearance as a normal garment. In addition, the fastener tape moves in accordance with the change of the waist size, so that there are no wrinkles or the like generated around the waist.

The second buttonhole may have any kind of shapes, such as a straight hole like a quill shaped hole (bachi-ana in Japanese) or the like.

The upper end of the first fastener tape is stitched to the upper end of the outer fold of the garment via the sliding tape and the rubber tape at an inside of a back fabric of the outside belt portion. The sliding tape is held and stitched inside the outside belt portion in the inclined manner toward the outside of the edge of the outer fold. The outside belt portion is provided with the buttonhole 6 that is buttonholed. The buttonhole passes through part of the sliding tape and the rubber tape that are attached inside the outside belt portion. The sliding tape and the rubber tape are also stitched by the buttonholing of the buttonhole. However, in the garment having the waist size adjusting mechanism of the invention, the first fastener tape is supported not only by the sliding tape but also by the rubber tape. Consequently, the first fastener tape can also move in accordance with a extension of the tuck by a stretching force of the rubber tape when the folded/overlapped portion of the tuck is extended. Thus, the first fastener tape is never hindered from moving even if the outside belt portion is provided with the buttonhole and the buttonhole is buttonholed.

Moreover, the stitched round hole or the ring hole as the through hole is provided on the inside belt facing of the garment at a position corresponding to around the center of the moving cloth when the moving cloth returns to the original position by the elastic force of the elastic material. Thereby, even if the button comes off, the button can be reattached by passing a needle through the round part of the second buttonhole by use of the stitched round hole or the ring hole as the through-hole as a guide. Therefore, the button is easier to be stitched and attached more durably.

As described above, the garment having the waist size adjusting mechanism has the same appearance as the ordinary garment and is able to continuously change the waist size while keeping the improved appearance. In addition, when the button comes off, the button is enabled to be more easily reattached with durability.

According to a seventh aspect of the invention, there is provided a garment having a waist size adjusting mechanism. In the garment, a coupling device joins one and another parts of a garment in a separable way and making a waist size of the garment adjustable within a predetermined range. A tuck is provided on an outer fold of the garment so as to extend generally in a vertical direction. The tuck is capable of changing its shape within such a range as the coupling device makes the waist size of the garment adjustable. A fastener has a first fastener tape and a second fastener tape. The first fastener tape as a seam allowance is sewn on the tuck provided on the outer fold of the garment. The second fastener tape as a seam allowance is sewn on an inner fold of the garment. A moving cloth of a predetermined length is attached to an inside belt portion of the garment via an elastic material so as to be movable along a waistband. A button is stitched on the moving cloth with a predetermined length of a thread base or a neck-wrapping. A second buttonhole is provided on a front fabric of the inside belt portion of the garment. The button is passed through the second buttonhole from a rear side to a front side. The button is movable in accordance with the moving cloth as the moving cloth moves along the waistband against an elastic force of the elastic material. An inside belt facing of the garment has a stitched round hole or a ring hole as a through hole provided at a position corresponding to nearly a center of the moving cloth when the moving cloth returns to an original position by the elastic force of the elastic material. An upper end part of the first fastener tape is stitched in an inclined manner toward an outside. The coupling device includes the button that is stitched to the moving cloth and that is taken out to the front side through the second buttonhole and a buttonhole that is provided on an outside belt portion of the garment.

According to the seventh aspect of the invention, the tuck is provided on the outer fold of trousers or the like on which the fastener tapes are stitched so that the fastener tapes is allowed to move in accordance with a change of the waist size. The button is stitched on the moving cloth having the predetermined length that is attached to the inside belt portion of the garment via the elastic material so as to be movable along the waistband or in a waist direction. The button is protruded or taken out to the front side from the second buttonhole that is provided on the front fabric of the inside belt portion. Then, the button is engaged in the buttonhole provided on the outside belt portion. Thus, the waist size becomes a free size since the button moves inside the second buttonhole within a range in which the elastic material can stretch. Accordingly, the garment gives a wearer a comfortable wear feeling. Moreover, the second buttonhole is hidden when the button is engaged with the buttonhole of the outside belt portion. Thereby, the garment having the waist size adjusting mechanism has completely the same appearance as a normal garment. In addition, the fastener tape moves in accordance with the change of the waist size, so that there are no wrinkles or the like generated around the waist.

The upper end of the first fastener tape is stitched in an inclined manner toward the outside. Therefore, the first fastener tape can also move in accordance with an extension of the tuck when the folded/overlapped portion of the tuck is extended. In addition, since the sliding tape is not provided, the first fastener tape is not hindered from moving even if the buttonhole is provided at the outside belt portion and is buttonholed.

The second buttonhole may have any kind of shapes, such as a straight hole like a quill shaped hole (bachi-ana in Japanese) or the like.

Moreover, the stitched round hole or the ring hole as the through hole is provided on the inside belt facing of the garment at a position corresponding to around the center of the moving cloth when the moving cloth returns to the original position by the elastic force of the elastic material. Thereby, even if the button comes off, the button can be reattached by passing a needle through the round part of the second buttonhole by use of the stitched round hole or the ring hole as the through-hole as a guide. Therefore, the button is easier to be stitched and attached more durably.

As described above, the garment having the waist size adjusting mechanism has the same appearance as the ordinary garment and is able to continuously change the waist size while keeping the improved appearance. In addition, when the button comes off, the button is enabled to be more easily reattached with durability.

According to an eighth aspect of the invention, there is provided a garment having a waist size adjusting mechanism. In the garment, a coupling device joins one and another parts of a garment in a separable way and making a waist size of the garment adjustable within a predetermined range. An adjusting cloth of generally a tubular shape is sewn on an outer fold of the garment so as to extend generally in a vertical direction. The adjusting cloth is capable of changing its shape within such a range as the coupling device makes the waist size of the garment adjustable. A moving cloth of a predetermined length is attached to an inside belt portion of the garment via an elastic material so as to be movable along a waistband. A button is stitched on the moving cloth with a predetermined length of a thread base or a neck-wrapping. A second buttonhole is provided on a front fabric of the inside belt portion of the garment. The button is passed through the second buttonhole from a rear side to a front side. The button is movable in accordance with the moving cloth as the moving cloth moves along the waistband against an elastic force of the elastic material. A fastener has a first fastener tape and a second fastener tape. The first fastener tape as a seam allowance is sewn on the adjusting cloth sewn on the outer fold of the garment. The second fastener tape as a seam allowance is sewn on an inner fold of the garment. An inside belt facing of the garment has a stitched round hole or a ring hole as a through hole provided at a position corresponding to nearly a center of the moving cloth when the moving cloth returns to an original position by the elastic force of the elastic material. An upper end part of the first fastener tape is stitched in an inclined manner toward an outside. The coupling device includes the button that is stitched to the moving cloth and that is taken out to the front side through the second buttonhole and a buttonhole that is provided on an outside belt portion of the garment.

According to the eighth aspect of the invention, the adjusting cloth of generally the tubular shape is stitched to the outer fold of trousers or the like on which the fastener tapes are stitched so that the fastener tapes is allowed to move in accordance with a change of the waist size. The button is stitched on the moving cloth having the predetermined length that is attached to the inside belt portion of the garment via the elastic material so as to be movable along the waistband or in a waist direction. The button is protruded or taken out to the front side from the second buttonhole that is provided on the front fabric of the inside belt portion. Then, the button is engaged in the buttonhole provided on the outside belt portion. Thus, the waist size becomes a free size since the button moves inside the second buttonhole within a range in which the elastic material can stretch. Accordingly, the garment gives a wearer a comfortable wear feeling. Moreover, the second buttonhole is hidden when the button is engaged with the buttonhole of the outside belt portion. Thereby, the garment having the waist size adjusting mechanism has completely the same appearance as a normal garment. In addition, the fastener tape moves in accordance with the change of the waist size, so that there are no wrinkles or the like generated around the waist.

The upper end of the first fastener tape is stitched in an inclined manner toward the outside. Therefore, the first fastener tape can also move in accordance with a deformation of the adjusting cloth when the adjusting cloth of generally the tubular shape is deformed. In addition, since the sliding tape is not provided, the first fastener tape is not hindered from moving even if the buttonhole is provided at the outside belt portion and is buttonholed.

The second buttonhole may have any kind of shapes, such as a straight hole like a quill shaped hole (bachi-ana in Japanese) or the like.

Moreover, the stitched round hole or the ring hole as the through hole is provided on the inside belt facing of the garment at a position corresponding to around the center of the moving cloth when the moving cloth returns to the original position by the elastic force of the elastic material. Thereby, even if the button comes off, the button can be reattached by passing a needle through the round part of the second buttonhole by use of the stitched round hole or the ring hole as the through-hole as a guide. Therefore, the button is easier to be stitched and attached more durably.

As described above, the garment having the waist size adjusting mechanism has the same appearance as the ordinary garment and is able to continuously change the waist size while keeping the improved appearance. In addition, when the button comes off, the button is enabled to be more easily reattached with durability.

According to a ninth aspect of the invention, there is provided a garment having a waist size adjusting mechanism. In the garment, a coupling device joins one and another parts of a garment in a separable way and making a waist size of the garment adjustable within a predetermined range. A moving cloth of a predetermined length is attached to an inside belt portion of the garment via an elastic material so as to be movable along a waistband. A button is stitched on the moving cloth with a predetermined length of a thread base or a neck-wrapping. A second buttonhole is provided on a front fabric of the inside belt portion of the garment. The button is passed through the second buttonhole from a rear side to a front side. The button is movable in accordance with the moving cloth as the moving cloth moves along the waistband against an elastic force of the elastic material. An inside belt facing of the garment has a stitched round hole or a ring hole as a through hole provided at a position corresponding to nearly a center of the moving cloth when the moving cloth returns to an original position by the elastic force of the elastic material. The coupling device includes the button that is stitched to the moving cloth and that is taken out to the front side through the second buttonhole and a buttonhole that is provided on an outside belt portion of the garment.

According to the ninth aspect of the invention, the button is stitched on the moving cloth having the predetermined length that is attached to the inside belt portion of the garment via the elastic material so as to be movable along the waistband or in a waist direction. The button is protruded or taken out to the front side from the second buttonhole that is provided on the front fabric of the inside belt portion. Then, the button is engaged in the buttonhole provided on the outside belt portion. Thus, the waist size becomes a free size since the button moves inside the second buttonhole within a range in which the elastic material can stretch. Accordingly, the garment gives a wearer a comfortable wear feeling. Moreover, the second buttonhole is hidden when the button is engaged with the buttonhole of the outside belt portion. Thereby, the garment having the waist size adjusting mechanism has completely the same appearance as a normal garment.

The second buttonhole may have any kind of shapes, such as a straight hole like a quill shaped hole (bachi-ana in Japanese) or the like.

Moreover, the stitched round hole or the ring hole as the through hole is provided on the inside belt facing of the garment at a position corresponding to around the center of the moving cloth when the moving cloth returns to the original position by the elastic force of the elastic material. Thereby, even if the button comes off, the button can be reattached by passing a needle through the round part of the second buttonhole by use of the stitched round hole or the ring hole as the through-hole as a guide. Therefore, the button is easier to be stitched and attached more durably.

As described above, the garment having the waist size adjusting mechanism has the same appearance as the ordinary garment and is able to continuously change the waist size while keeping the improved appearance. In addition, when the button comes off, the button is enabled to be more easily reattached with durability.

According to a tenth aspect of the invention, in any one of the above garments, the moving cloth is composed of a fabric of a predetermined size and a thin and stiff padding of generally a same size as the fabric. The fabric and the thin and stiff padding are joined and stuck to each other and/or have their circumference sewn on each other by overlocking.

According to the tenth aspect of the invention, the moving cloth is composed of a fabric of a predetermined size and a thin and stiff padding of generally a same size as the fabric. The fabric and the thin and stiff padding are joined and stuck to each other and/or have their circumference sewn on each other by overlooking. Therefore, the moving cloth becomes thin and durable. Thus, the moving cloth is enabled to move smoothly inside the belt portion. Accordingly, the a garment having the waist size adjusting mechanism has the same appearance as the ordinary garment. Moreover, the garment is able to continuously change the waist size, while keeping the improved appearance. Furthermore, when the button comes off, the button is allowed to be reattached more easily and durably. In addition, since the moving cloth is reinforced by the stiff padding, the run-off of the moving cloth is surely prevented.

According to an eleventh aspect of the invention, in any one of the above garments, an expansion-preventing material is disposed in combination with the elastic material so as to regulate a maximum extension of the elastic material.

According to the eleventh aspect of the invention, the expansion-preventing material is disposed in combination with the elastic material so as to regulate the maximum extension of the elastic material.

Accordingly, since the garment having the waist size adjusting mechanism can regulate the maximum extension or length of the elastic material so that the button is not pulled beyond the length of the second buttonhole along the length of which the button is movable. Thus, there are no wrinkles generated on the garment and the appearance of the garment is never affected or spoiled. Moreover, the garment having the waist size adjusting mechanism can prevent an excessive tension from being applied on the elastic material. Consequently, the elastic material is given a longer life.

As described above, the garment having the waist size adjusting mechanism has the same appearance as the ordinary garment and is able to continuously change the waist size while keeping the improved appearance. Moreover, the garment can prolong the life of the elastic material. In addition, when the button comes off, the button is enabled to be more easily reattached with durability.

According to a twelfth aspect of the invention, in any one of the above garments, the expansion-preventing material is stitched and joined to the elastic material and the moving cloth and protruded from the moving cloth so as to be stitched to an inside belt facing of the garment. The expansion-preventing material has a full length of longitudinal opposite edges sewn by overlooking.

According to the twelfth aspect of the invention, the expansion-preventing material is stitched and joined to the elastic material and the moving cloth and protruded from the moving cloth so as to be stitched to an inside belt facing of the garment. The expansion-preventing material has a full length of longitudinal opposite edges sewn by overlocking.

In this case, the elastic material and the moving cloth are sewn on a base of the expansion-preventing material. Therefore, the moving cloth unit can be manufactured more easily. Moreover, the entire opposite longitudinal edges of the expansion-preventing material are sewn by overlooking along their full length. Therefore, the expansion-preventing material can be constituted by a single thin cloth. A portion of the expansion-preventing material that is protruded from the moving cloth acts as a tensile member. Therefore, the moving cloth can move smoothly inside the belt portion since it is thin.

As described above, the garment having the waist size adjusting mechanism has the same appearance as the ordinary garment and is able to continuously change the waist size. In addition, when the button comes off, the button is enabled to be more easily reattached with durability.

According to a thirteenth aspect of the invention, any one of the above garments further comprises a vertical tape and one or more horizontal run-off prevention tapes that serve in combination to prevent the moving cloth from swinging in a vertical direction and from running off from the second buttonhole. The vertical tape has opposite ends stitched to the inside belt portion. The horizontal tape is passed under the vertical tape so as to be movable in a horizontal direction and stitched to a rear side of the moving cloth.

According to the thirteenth aspect of the invention, the garment further comprises the vertical tape and the one or more horizontal run-off prevention tapes that serve in combination to prevent the moving cloth from swinging in a vertical direction and from running off from the second buttonhole. The vertical tape has opposite ends stitched to the inside belt portion. The horizontal tape is passed under the vertical tape so as to be movable in a horizontal direction and stitched to a rear side of the moving cloth. Therefore, even if an excessive force is applied to the button and the button is pulled upward, the moving cloth and the elastic material on which the button is stitched are prevented from a so-called "run-off or blow-out" or being pulled out from the second buttonhole.

As described above, the garment having the waist size adjusting mechanism has the same appearance as the ordinary garment and is able to continuously change the waist size. Moreover, the garment can prevent run-off of the moving cloth. In addition, when the button comes off, the button is enabled to be more easily reattached with durability.

According to a fourteenth aspect of the invention, any one of the above garments further comprises a horizontal tape and one ore more vertical run-off prevention tapes that serve in combination to prevent the moving cloth from swinging in a vertical direction and from running off from the second buttonhole. The horizontal tape has opposite ends stitched to the inside belt portion at a position corresponding to the buttonhole provided on the outside belt portion. The vertical run-off prevention tape is passed under the horizontal tape so as to be movable in a horizontal direction and stitched to a rear side of the moving cloth.

According to the fourteenth aspect of the invention, the garment further comprises the horizontal tape and the one ore more vertical run-off prevention tapes that serve in combination to prevent the moving cloth from swinging in the vertical direction and from running off from the second buttonhole. The horizontal tape has opposite ends stitched to the inside belt portion at a position corresponding to the buttonhole provided on the outside belt portion. The vertical run-off prevention tape is passed under the horizontal tape so as to be movable in a horizontal direction and stitched to the rear side of the moving cloth. Therefore, even if an excessive force is applied to the button and the button is pulled upward, the moving cloth and the elastic material on which the button is stitched are prevented from a so-called "run-off or blow-out" or being pulled out from the second buttonhole.

As described above, the garment having the waist size adjusting mechanism has the same appearance as the ordinary garment and is able to continuously change the waist size. Moreover, the garment can prevent run-off of the moving cloth. In addition, when the button comes off, the button is enabled to be more easily reattached with durability.

According to a fifteenth aspect of the invention, in any one of the above garments, the coupling device includes the button that is stitched to the moving cloth and that is taken out to the front side through the second buttonhole, the buttonhole that is provided on the outside belt portion of the garment, and a hook structure and an eyelet structure used in combination, the hook structure and the eyelet structure being attached to the outside belt portion and a rear side of the inside belt portion of the garment, respectively, and vice versa.

According to the fifteenth aspect of the invention, the coupling device includes the button that is stitched to the moving cloth and that is taken out to the front side through the second buttonhole, the buttonhole that is provided on the outside belt portion of the garment, and the hook structure and the eyelet used in combination, the hook structure and the eyelet structure being attached to the outside belt portion and a rear side of the inside belt portion of the garment, respectively, and vice versa.

Therefore, in case only the button and the buttonhole are engaged, the waist size can be changed within a range in which the elastic material is stretchable, that is the waist becomes free-size. Moreover, if the hook structure attached to the belt portion of the inner fold or the outer fold is engaged with the eyelet structure attached to the outside belt portion or the inside belt portion, the waist size is fixed at a constant size.

As described above, the garment having the waist size adjusting mechanism has the same appearance as the ordinary garment and is able to continuously change the waist size. That is, the garment can easily switch a free waist size state and a fixed waist size state. In addition, when the button comes off, the button is enabled to be more easily reattached with durability.

According to a sixteenth aspect of the invention, in any one of the above garments, the moving cloth and the expansion-preventing material are each composed of a lining cloth having a color similar to the front fabric of the belt portion.

According to the sixteenth aspect of the invention, the moving cloth and the expansion-preventing material are each composed of a lining cloth having a color similar to the front fabric of the belt portion. Since the lining cloth easily slide or slips and is thin. Therefore, the expansion and contraction of the elastic material and the movement of the moving cloth are performed smoothly very much. In addition, the lining cloth has a color similar to the front fabric of the belt portion. Therefore, even if the second buttonhole is exposed when the front opening of the garment is opened or released, the moving cloth and the expansion-preventing material are inconspicuous. Therefore, the outside appearance of the garment is not spoiled or affected.

As described above, the garment having the waist size adjusting mechanism can perform the stretching (expanding/contracting) action of the elastic material and the moving action of the moving cloth very smoothly. Moreover, the second button is inconspicuous. In addition, when the button comes off, the button can be reattached more easily and durably.

According to a seventeenth aspect of the invention, any one of the above garments further comprises a stiff pad for reinforcing an upper half and/or a lower half of the inside belt portion of the garment and/or the moving cloth.

According to the seventeenth aspect of the invention, the garment further comprises the stiff pad for reinforcing the upper half and/or the lower half of the inside belt portion of the garment and/or the moving cloth. Thus, the movement of the moving cloth is made smooth. Moreover, the inside belt portion of the garment is prevented from producing wrinkles when the moving cloth moves in an elongating direction of the elastic material. In addition, since the upper half and/or the moving cloth is reinforced by the stiff padding, the run-off of the moving cloth is prevented.

As described above, the garment having the waist size adjusting mechanism can perform the movement of the moving cloth very smoothly. Moreover, the garment has the same appearance as the ordinary garment and is able to continuously change the waist size. In addition, when the button comes off, the button is enabled to be more easily reattached with durability.

Other objects, features and advantages of the present invention will become apparent upon a reading of the following detailed description in conjunction with the accompanying drawings.

BRIEF DESCRIPTION OF THE DRAWINGS

FIG. 1*b* shows a first modified example of a garment having a waist size adjusting mechanism according to the first embodiment of the invention. FIG. 1*c* shows a second modified example of a garment having a waist size adjusting mechanism according to the first embodiment of the invention. FIG. 1*d* shows a third modified example of a garment having a waist size adjusting mechanism according to the first embodiment of the invention. FIG. 1*e* shows a fourth modified example of a garment having a waist size adjusting mechanism according to the first embodiment of the invention.

FIG. 8*a* shows an initial step of the process, FIG. 8*b* shows a middle step of the process and FIG. 8*c* shows a final step or a finished state of the process.

FIG. 9*a* shows a first modified example of an inside belt portion of the garment having the waist size adjusting mechanism according to the first embodiment of the invention. FIG. 9*b* shows second modified example of an inside belt portion of the garment having the waist size adjusting mechanism according to the first embodiment of the invention. FIG. 9*c* shows a third modified example of an inside belt portion of the garment having the waist size adjusting mechanism according to the first embodiment of the invention. FIG. 9*d* shows a fourth modified example of an inside belt portion of the garment having the waist size adjusting mechanism according to the first embodiment of the invention. FIG. 9*e* shows a fifth modified example of an inside belt portion of the garment having the waist size adjusting mechanism according to the first embodiment of the invention.

FIG. 10*a* shows an expansion plan view of the inside belt portion in a totally unfolded state. FIG. 10*b* shows the inside belt portion in a finished and sewn state.

FIG. 11*a* shows a first modified example of a moving cloth unit. FIG. 11*b* shows a second modified example of a moving cloth unit.

FIGS. 13*a* and 13 are drawings showing an inside belt portion, seen from a front side, of a garment having a waist size adjusting mechanism according to a second embodiment of the invention. FIG. 13*a* shows an expansion plan view of the inside belt portion in a totally unfolded state.

FIG. 14*a* shows an initial step of the process, FIG. 14*b* shows a middle step of the process and FIG. 14*c* shows a final step or a finished state of the process.

FIG. 15*a* shows an initial step of the process, FIG. 15*b* shows a middle step of the process and FIG. 15*c* shows a final step or a finished state of the process.

FIG. 17*a* shows an initial step of the process, FIG. 17*b* shows a middle step of the process and FIG. 17*c* shows a final step or a finished state of the process.

DETAILED DESCRIPTION OF THE PREFERRED EMBODIMENTS

Figure 1A:
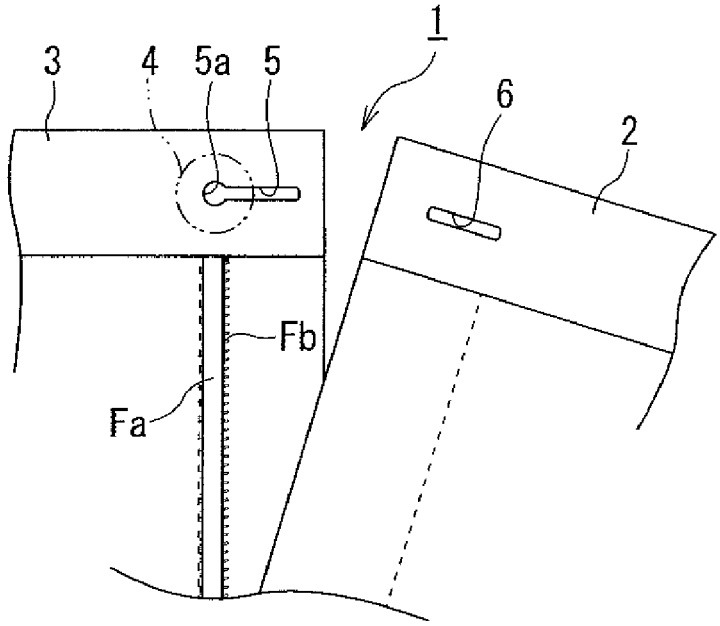
FIG. 1*a* is a partial elevation view showing a state in which a front opening is released in a garment having a waist size adjusting mechanism according to a first embodiment of the invention.

Several preferred embodiments of the invention will be described hereafter referring to the attached drawings. A garment having a waist size adjusting mechanism of the invention is applied mainly to ladies or women's trousers (ladies' pants) but also is applicable to gentlemen's or men's trousers. The same reference character or reference numeral is used to show the same element or same part throughout the several embodiments.

First Embodiment

A first embodiment of the invention is described referring to FIG. 1 to FIG. 12. The first embodiment of the invention exemplifies a garment having a waist size adjusting mechanism that has a main application to ladies' pants.

Figure 1B:
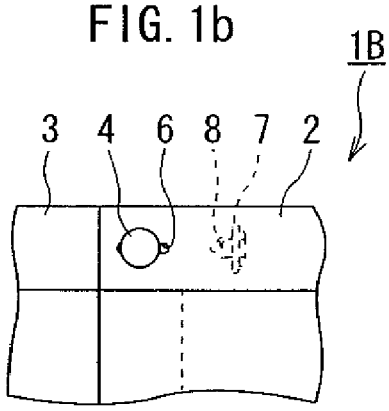
FIGS. 1*b* to 1*e* are drawings showing several modified examples of garments having a waist size adjusting mechanism according to the first embodiment of the invention.
Figure 1C:
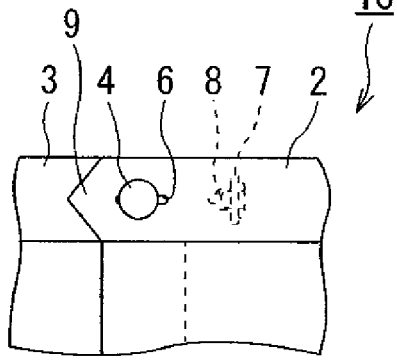
Figure 1D:
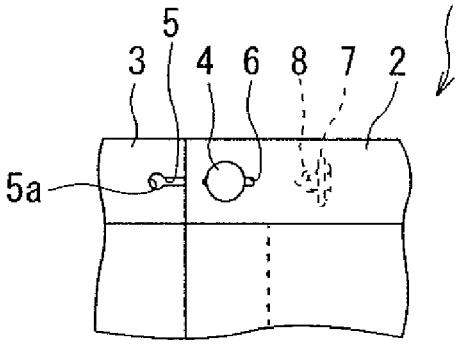
Figure 1E:
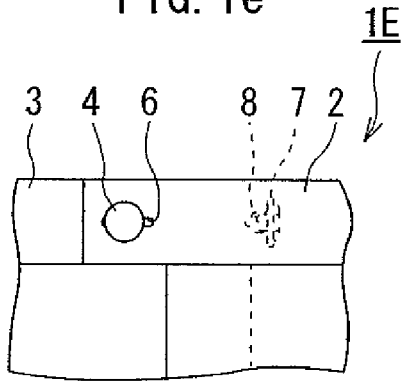
Figure 2:
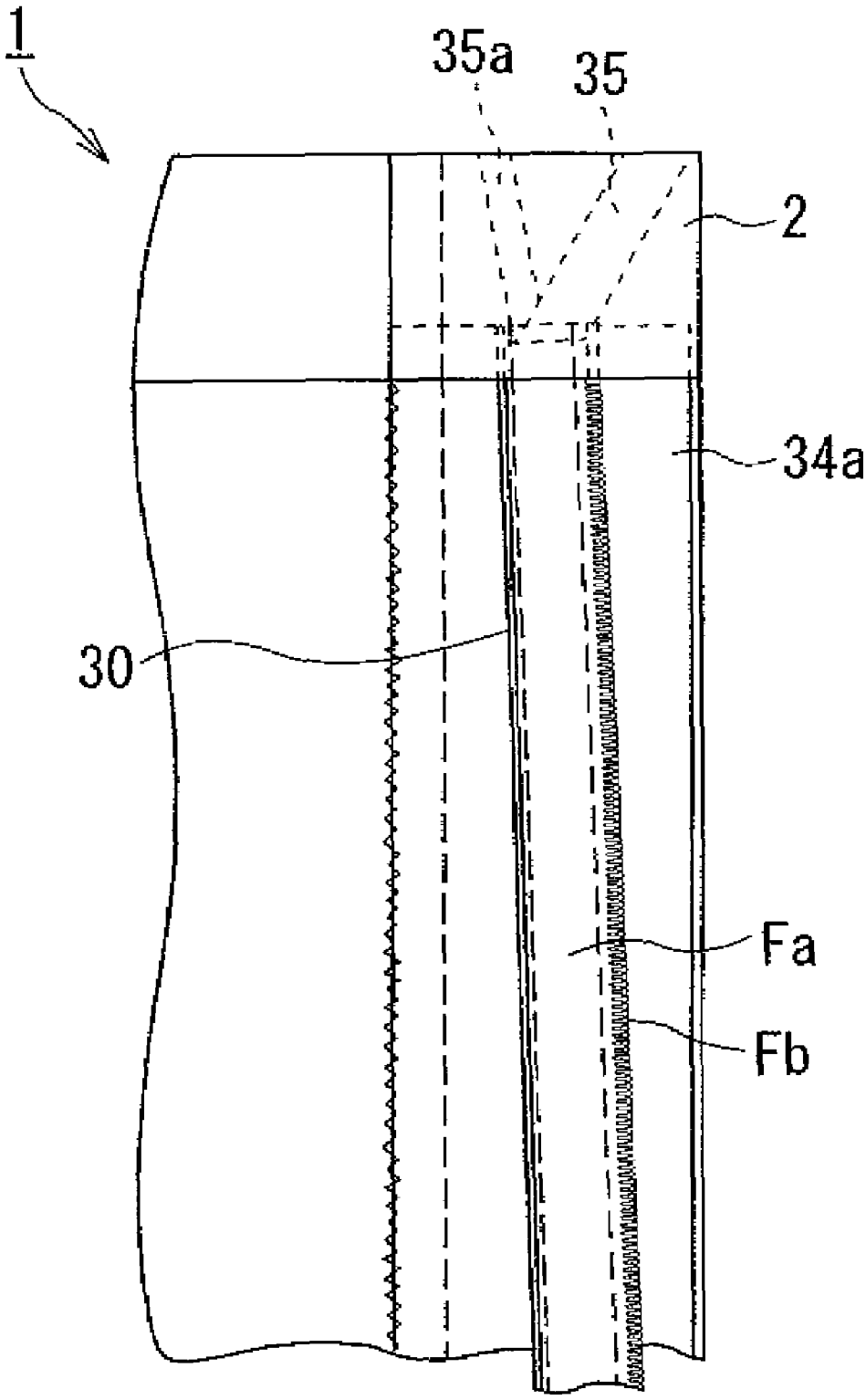
FIG. 2 is an explanatory drawing showing a structure of an outside belt portion of the garment having the waist size adjusting mechanism according to the first embodiment of the invention.
Figure 3:
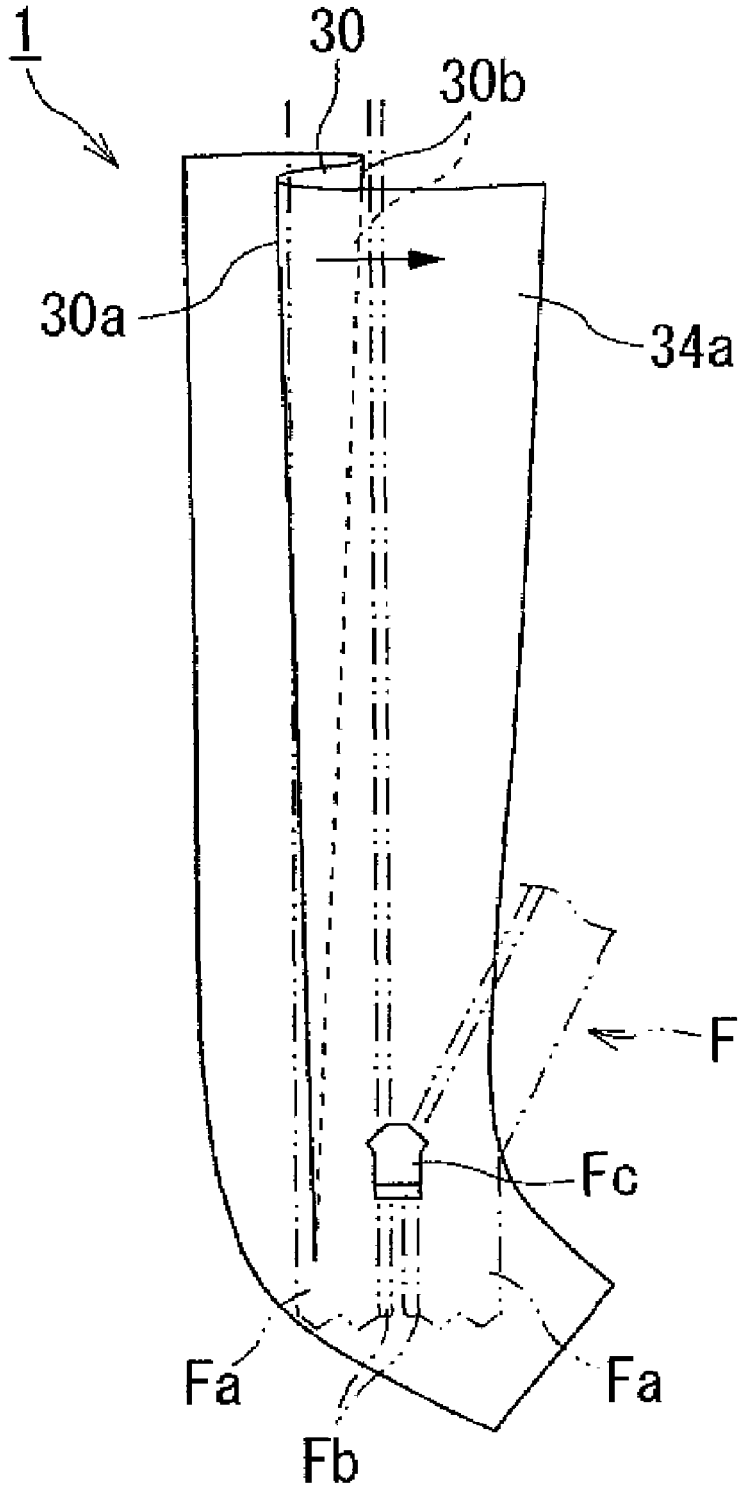
FIG. 3 is a perspective view showing a structure of a tuck provided on the outside belt portion of the garment having the waist size adjusting mechanism according to the first embodiment of the invention.
Figure 4:
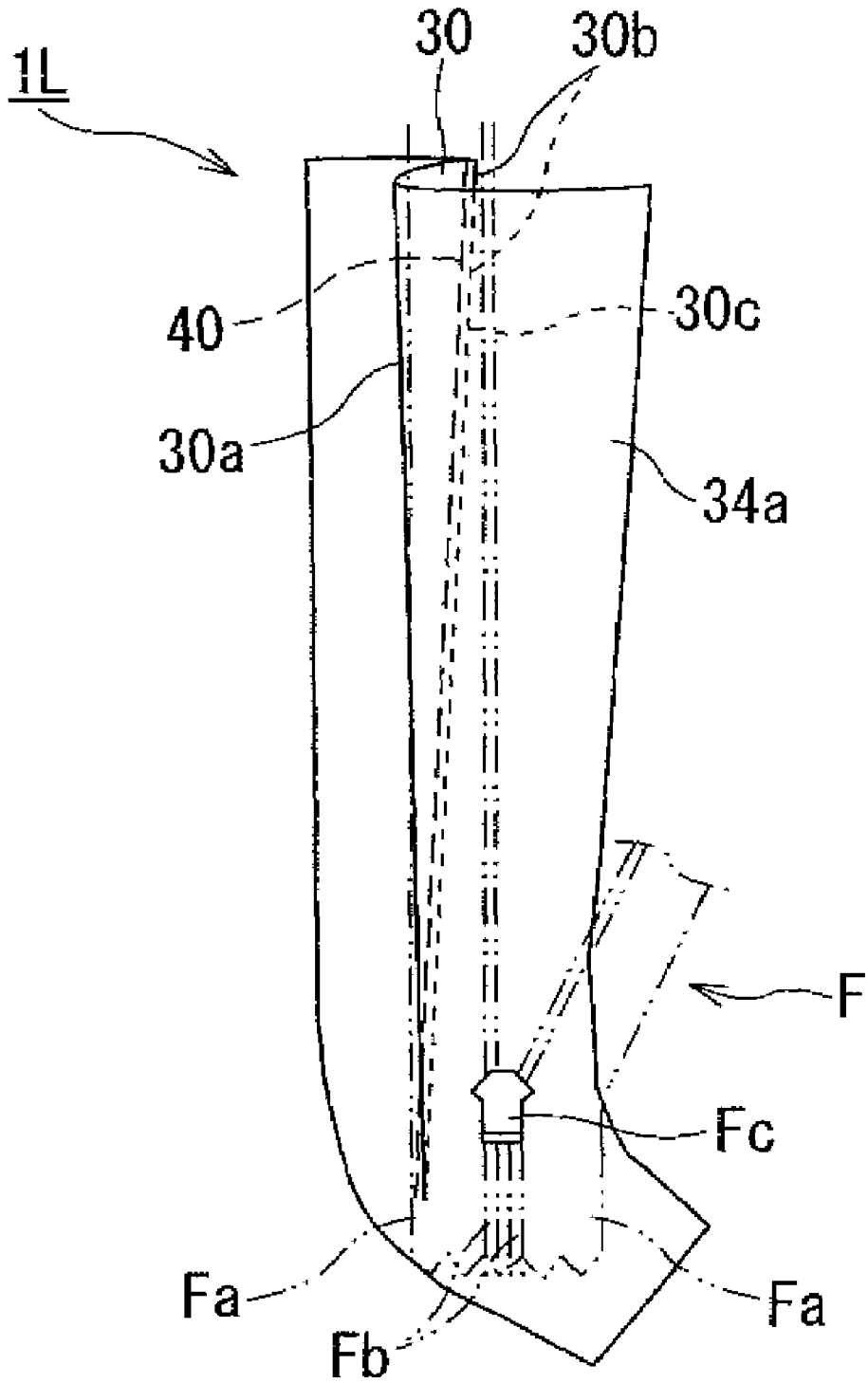
FIG. 4 is a perspective view showing a structure of a first modified example of a tuck portion in the garment having the waist size adjusting mechanism according to the first embodiment of the invention.

FIG. 1*a* is a partial elevation view showing a state in which a front opening is released in a garment having a waist size adjusting mechanism according to a first embodiment of the invention. FIGS. 1*b* to 1*e* are drawings showing several modified examples of garments having a waist size adjusting mechanism according to the first embodiment of the invention. FIG. 1*b* shows a first modified example of a garment having a waist size adjusting mechanism according to the first embodiment of the invention. FIG. 1*c* shows a second modified example of a garment having a waist size adjusting mechanism according to the first embodiment of the invention. FIG. 1*d* shows a third modified example of a garment having a waist size adjusting mechanism according to the first embodiment of the invention. FIG. 1*e* shows a fourth modified example of a garment having a waist size adjusting mechanism according to the first embodiment of the invention. FIG. 2 is an explanatory drawing showing a structure of an outside belt portion of the garment having the waist size adjusting mechanism according to the first embodiment of the invention. FIG. 3 is a perspective view showing a structure of a tuck provided on the outside belt portion of the garment having the waist size adjusting mechanism according to the first embodiment of the invention. FIG. 4 is a perspective view showing a structure of a first modified example of a tuck portion in the garment having the waist size adjusting mechanism according to the first embodiment of the invention.

Figure 5:
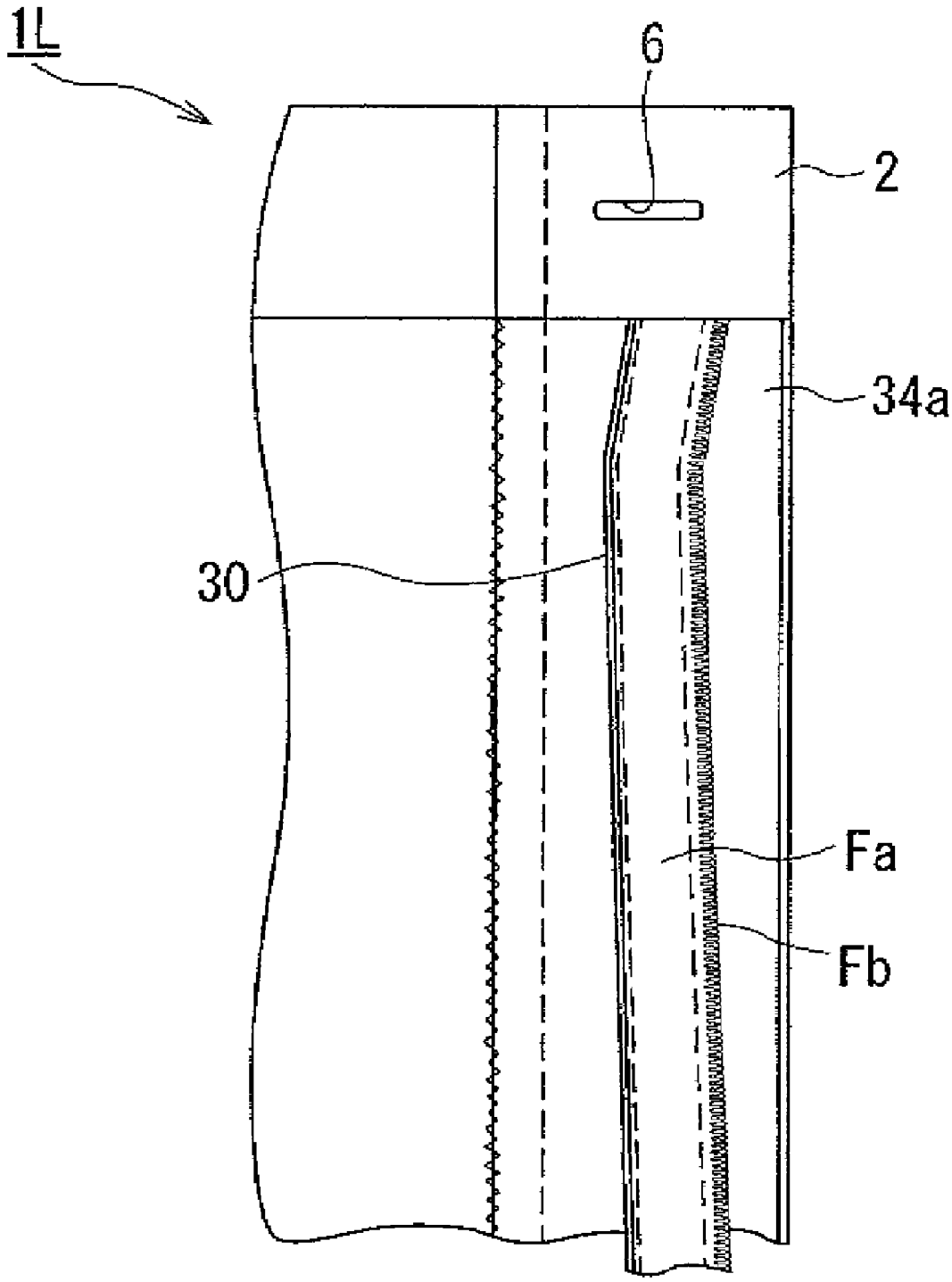
FIG. 5 is a drawing showing a structure of the first modified example of a fastener portion in the garment having the waist size adjusting mechanism according to the first embodiment of the invention.
Figure 6A:
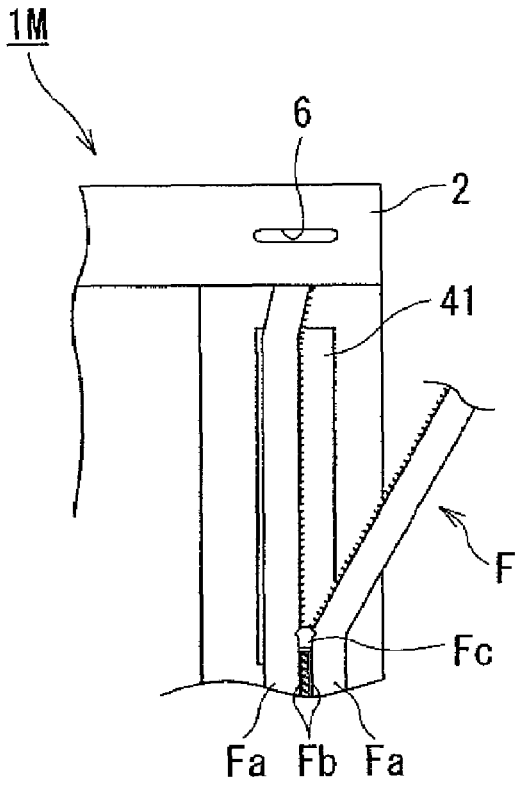
FIG. 6*a* is a drawing showing a structure of a second modified example of a fastener portion before a fastener is sewn to a tubular adjusting cloth in the garment having the waist size adjusting mechanism according to the first embodiment of the invention.
Figure 6B:
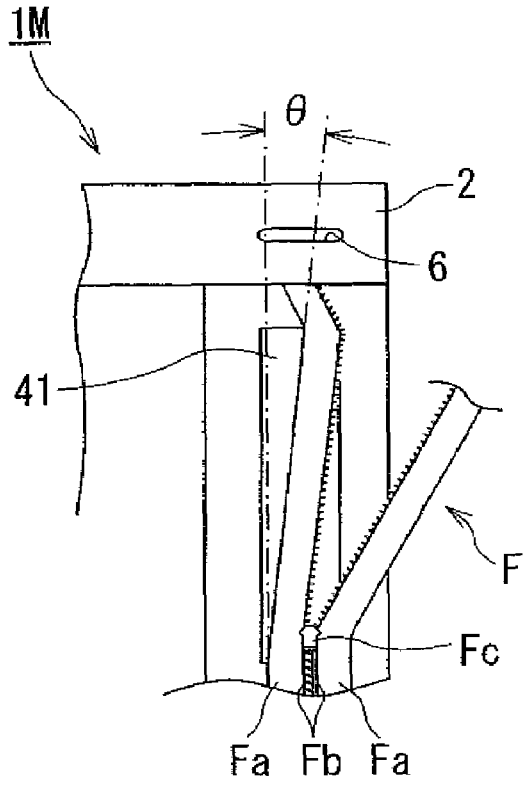
FIG. 6*b* is a drawing showing a structure of a second modified example of a fastener portion after the fastener is sewn to the tubular adjusting cloth in the garment having the waist size adjusting mechanism according to the first embodiment of the invention.
Figure 7A:
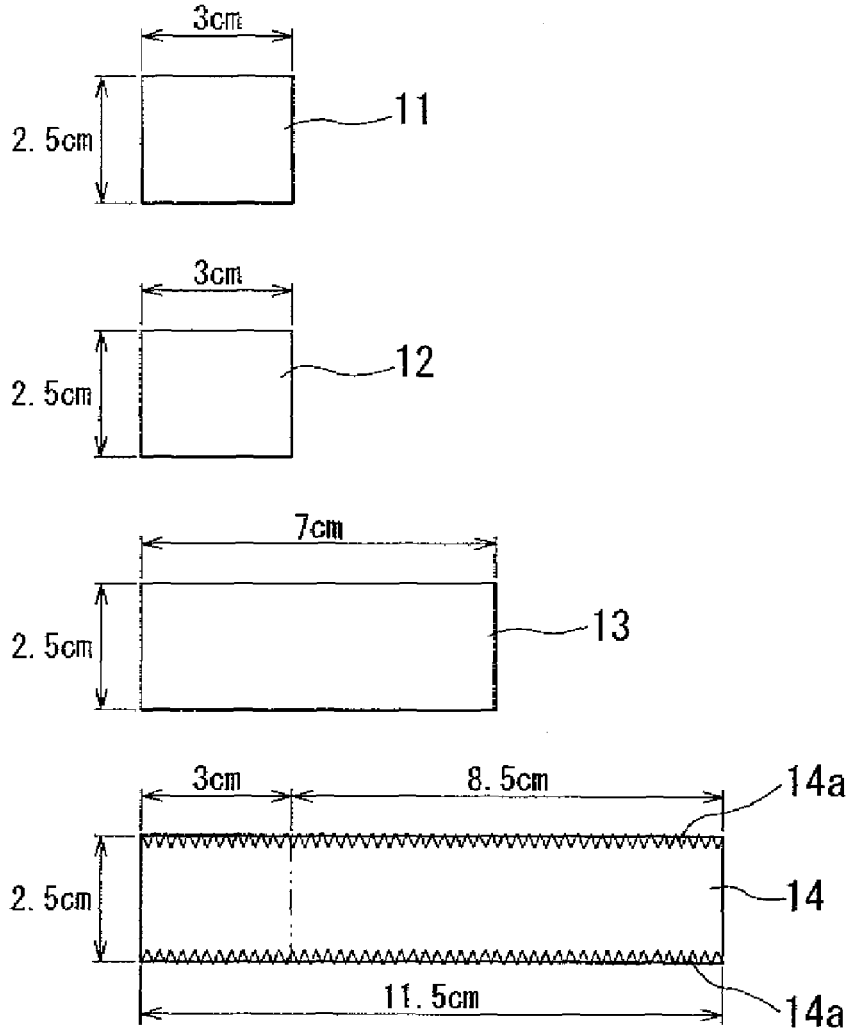
FIG. 7*a* is a drawing showing parts or components for fabricating a moving cloth unit of the garment having the waist size adjusting mechanism according to the first embodiment of the invention.
Figure 7B:
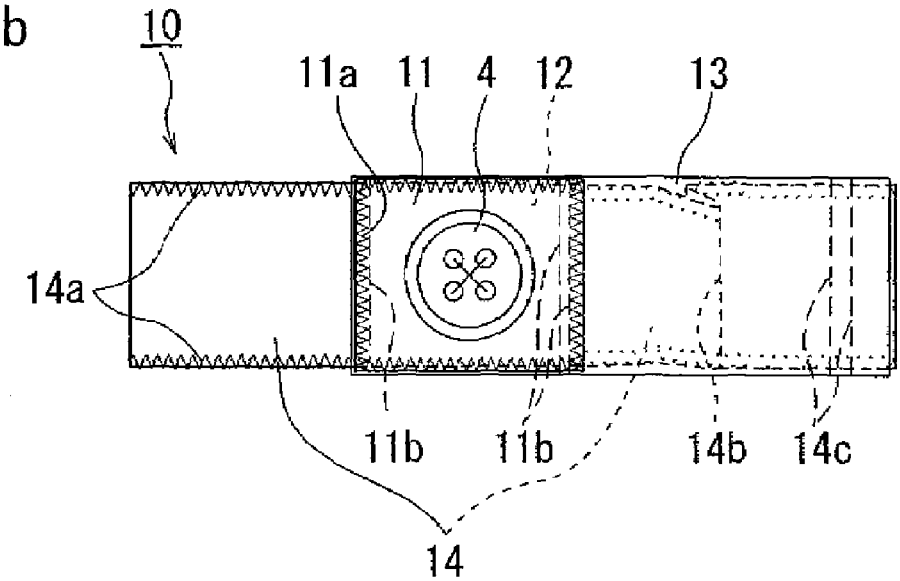
FIG. 7*b* is a drawing showing a finished assembled state of the moving cloth unit of FIG. 7*a*.
Figure 8A:
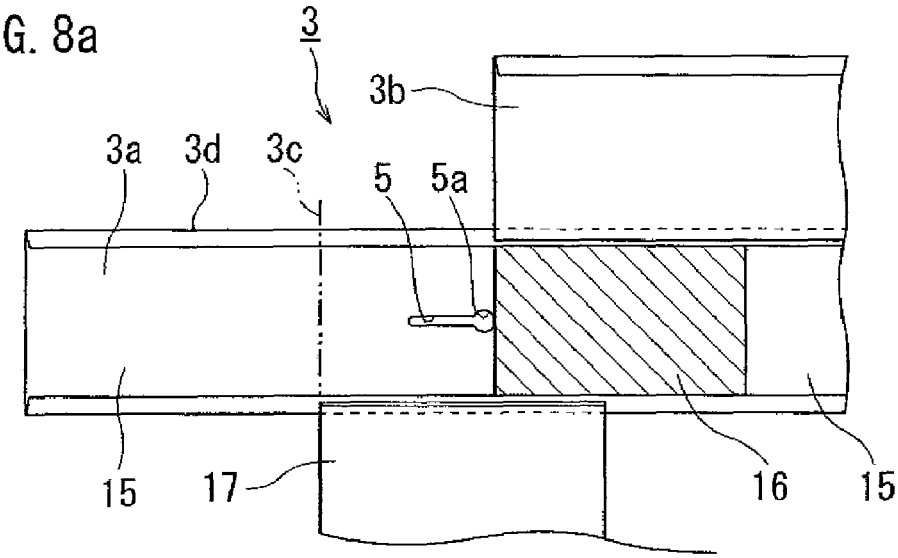
FIGS. 8*a*, 8*b* and 8*c* are drawings depicting a process of fabricating an inside belt portion, seen from a rear side, in the garment having the waist size adjusting mechanism according to the first embodiment of the invention.
Figure 8B:
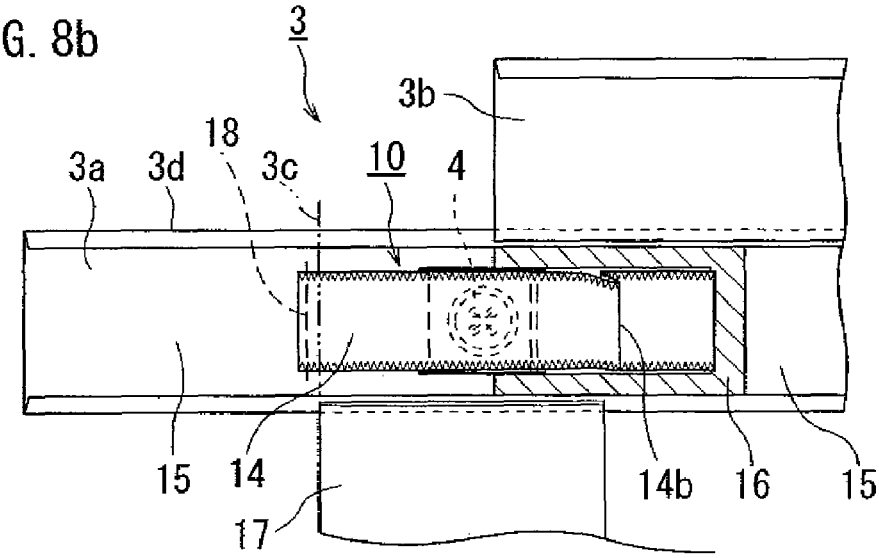
Figure 8C:
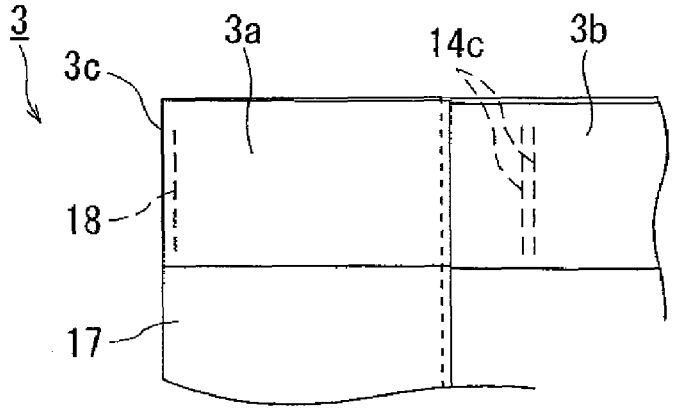

FIG. 5 is a drawing showing a structure of the first modified example of a fastener portion in the garment having the waist size adjusting mechanism according to the first embodiment of the invention. FIG. 6*a* is a drawing showing a structure of a second modified example of a fastener portion before a fastener is sewn to a tubular adjusting cloth in the garment having the waist size adjusting mechanism according to the first embodiment of the invention. FIG. 6*b* is a drawing showing a structure of a second modified example of a fastener portion after the fastener is sewn to the tubular adjusting cloth in the garment having the waist size adjusting mechanism according to the first embodiment of the invention. FIG. 7*a* is a drawing showing parts or components for fabricating a moving cloth unit of the garment having the waist size adjusting mechanism according to the first embodiment of the invention. FIG. 7*b* is a drawing showing a finished assembled state of the moving cloth unit of FIG. 7*a*. FIGS. 8*a*, 8*b* and 8*c* are drawings depicting a process of fabricating an inside belt portion, seen from a rear side, in the garment having the waist size adjusting mechanism according to the first embodiment of the invention. FIG. 8*a* shows an initial step of the process, FIG. 5*b* shows a middle step of the process and FIG. 5*c* shows a final step or a finished state of the process.

Figure 9A:
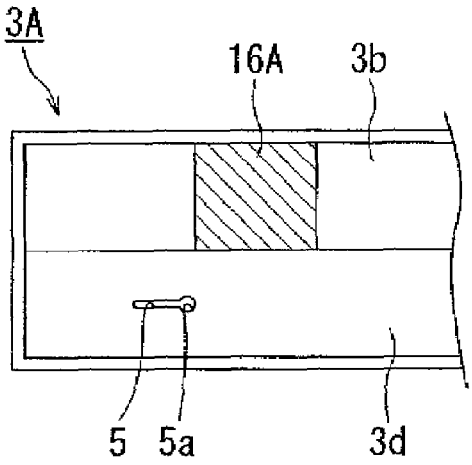
FIGS. 9*a* to 9*e* are exploded drawings showing several modified examples of inside belt portions in an unfolded state in the garment having the waist size adjusting mechanism according to the first embodiment of the invention.
Figure 9D:
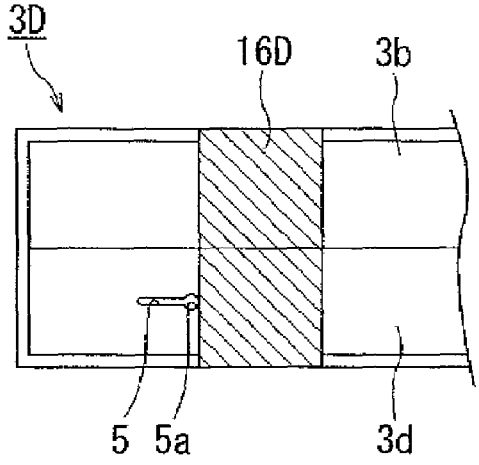
Figure 9B:
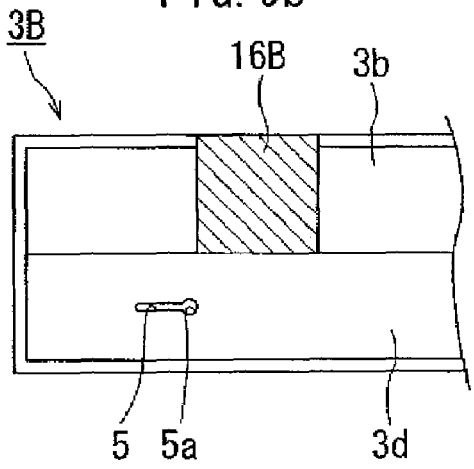
Figure 9E:
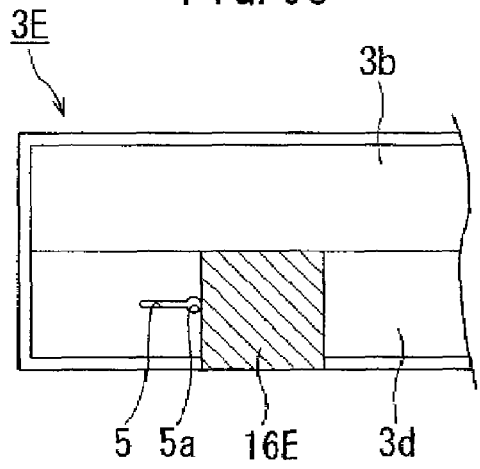
Figure 9C:
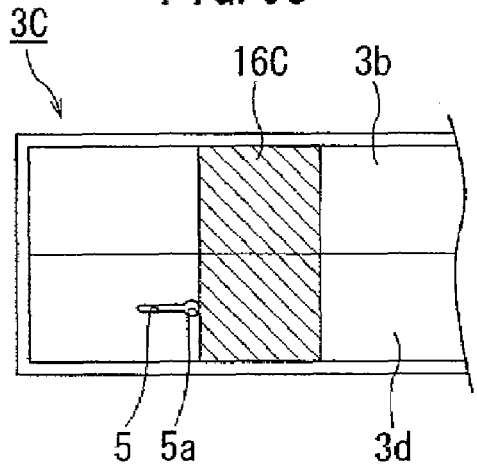

FIGS. 9*a* to 9*e* are exploded drawings showing several modified examples of inside belt portions in an unfolded state in the garment having the waist size adjusting mechanism according to the first embodiment of the invention. FIG. 9*a* shows a first modified example of an inside belt portion of the garment having the waist size adjusting mechanism according to the first embodiment of the invention. FIG. 9*b* shows second modified example of an inside belt portion of the garment having the waist size adjusting mechanism according to the first embodiment of the invention. FIG. 9*c* shows a third modified example of an inside belt portion of the garment having the waist size adjusting mechanism according to the first embodiment of the invention. FIG. 9*d* shows a fourth modified example of an inside belt portion of the garment having the waist size adjusting mechanism according to the first embodiment of the invention. FIG. 9*e* shows a fifth modified example of an inside belt portion of the garment having the waist size adjusting mechanism according to the first embodiment of the invention.

As shown in FIG. 1*a*, ladies' pants 1 as the garment having the waist size adjusting mechanism according to the first embodiment of the invention has a conventional or regular buttonhole 6 (a punched buttonhole as a kind of straight buttonhole or an eyelet buttonhole) formed on an outside belt portion 2. An eyelet buttonhole 5 as a second buttonhole is provided on an inside belt portion 3. The inside belt portion 3 incorporates therein a moving cloth. A button 4 (1.5 cm in diameter) is sewn on the moving cloth and taken out of the second buttonhole 5. The button 4 is movable in and along the second buttonhole 5. A round part of the eyelet buttonhole 5 as the second buttonhole is located at a position corresponding to about a center of the moving cloth when the moving cloth returns to an original or initial position by an elastic force of an elastic material. The outside belt portion 2 means an outer fold (fold or layer located at an outside) of the waistband of the pants that has an end part overlapping and masking an inner fold of the waistband, i.e. a left fold or left belt portion of the waistband in the present embodiment. The inside belt portion 3 means an inner fold (fold or layer located at an inside) of the waistband of the pants that has an end part overlapped and masked by the outer fold of the waistband, i.e. a right fold or right belt portion of the waistband in case of the present embodiment.

A slide fastener FB has a fastener tape Fa sewn on an inner fold or inside panel (right panel) of the pants (that is laid inside and partially overlapped under an outer fold or outside panel (left panel)). If the button 4 is engaged with the buttonhole 6 provided on the outside belt portion 2 and the slide fastener FB is engaged with a counterpart slide fastener (not-shown and sewn on the outside panel), a waist size of the ladies' pants 1 becomes continuously changeable so as to give a wearer relaxed wearing feeling. At this time, the second buttonhole 5 is hidden under the outside belt portion 2 when the button 4 is engaged with the buttonhole 6 of the outside belt portion 2. Thus, the garment having the waist size adjusting mechanism has the same appearance as conventional or normal pants. In addition, as described later in detail, a fastener tape of the counterpart slide fastener on the outside panel moves in accordance with a change of the waist size. Therefore, there are no wrinkles or the like generated around the waist.

The round part 5*a* of the eyelet buttonhole 5 as the second buttonhole is located at the position corresponding to around the center of the moving cloth when it returns to the original position by the elastic force of the elastic material. Accordingly, even if the button 4 is detached, a new button 4 can be stitched with scoop sewing through the round part 5*a* of the second buttonhole 5. Thus, the new button 4 is surely reattached to around the center of the moving cloth. Consequently, there is no need to locate a position for reattaching the button 4 when the button comes off, so that the button 4 can be easily reattached.

FIGS. 1*b*, 1*c*, 1*d* and 1*e* show modified examples of ladies' pants 1, respectively. As shown FIG. 1*b*, a first modified example of ladies' pants 1B have a protruded or extended part of 2.5 cm long provided on the inside belt portion 3. A male side (hook) 8 of hook and eye as a hooking structure is stitched to the protruded part. A female side (eye) 7 of the hook and eye as a hooked structure is stitched to a corresponding part at a rear of the outside belt portion 2. The waistband can be easily switched from a first state (adjustable condition) in which the waist size is continuously changeable to a second state (fixed condition) in which the waist size is fixed just by engaging the eye 7 and the hook 8. Since the second buttonhole 5 is 1.5 cm long, the second buttonhole 5 is hidden by the outside belt portion 2 and never seen from the outside.

As shown in FIG. 1*c*, a second modified example of ladies' pants 1C has also the protrude part of 2.5 cm long formed on the inside belt portion 3 in the same manner as the example of FIG. 1*b*. Moreover, the eye 7 and the hook 8 are stitched to the protruded part of the inside belt portion 3, too. Furthermore, a pointed extended part 9 of a triangular shape is formed on the outside belt portion 2. The second buttonhole 5 in the second modified example is 2.0 cm long and longer than the second buttonhole 5 in the first modified example shown in FIG. 1*b*. Still, with the above structure, the second buttonhole 5 is hidden by the pointed extended part 9 and never seen from the outside, even if the outside belt portion 2 is moved when the waist size is changed. In addition, the waistband can be easily switched from a first state (adjustable condition) in which the waist size is continuously changeable to a second state (fixed condition) in which the waist size is fixed just by engaging the eye 7 and the hook 8 in the second modified example, too.

As shown in FIG. 1*d*, a third modified example of ladies' pants D has also the protrude part of 2.5 cm long formed on the inside belt portion 3 in the same manner as the example of FIG. 1*b*. Moreover, the eye 7 and the hook 8 are stitched to the protruded part of the inside belt portion 3, too. The second buttonhole 5 in the third modified example is 2.5 cm long and much longer than the second buttonhole 5 in the first and second modified examples shown in FIG. 1*b*. Still, there is no pointed extended part provided on the outside belt portion 2. Therefore, part of the second buttonhole 5 is seen from the outside when the eye 7 and the hook 8 are engaged. However, since there are many customers who do not mind even if the second buttonhole 5 is seen to such a degree. Accordingly the ladies' pants 1D dare to avoid means to make or hide the second buttonhole 5.

As shown in FIG. 1*e*, a fourth modified example of ladies' pants 1E has a protruded or extended part of 4 cm long formed on the outside belt portion 2 instead of providing the projection on the inside belt portion 3. Accordingly, the second buttonhole 5 can be located at a position far away from an edge of the inside belt portion 3. Consequently, the hook 8 can be sewn on an end part of the lower front belt 3. The eye 7 is sewn on a corresponding position at a rear side of the outside belt portion 2. Then, the waistband can be easily switched from a first state (adjustable condition) in which the waist size is continuously changeable to a second state (fixed condition)

in which the waist size is fixed just by engaging the eye 7 and the hook 8. Since the second buttonhole 5 is 1.8 cm long, the second buttonhole 5 is hidden by the protruded part of the outside belt portion 2 and never seen from the outside.

As described above, in each of the modified examples of the ladies' pants 1B, 1C, 1D and 1E, the second buttonhole 5 is the eyelet buttonhole 5. Moreover, they are structured such that the round part 5*a* of the buttonhole 5 is located at the position corresponding around the center of the moving cloth when it returns to the original position by the elastic force of the elastic material. Thereby, even if the button 4 is detached, a new button 4 can be stitched with scoop sewing through the round part 5*a* of the second buttonhole 5. Thus, the new button 4 is surely reattached to around the center of the moving cloth. Consequently, there is no need to locate a position for reattaching the button 4 when the button comes off, so that the button 4 can be easily reattached.

Next described is a fastener tape moving mechanism in the ladies' pants 1, 1B, 1C, 1D and 1E as the garment having the waist size adjusting mechanism according to the first embodiment, referring to FIG. 2 and FIG. 3. FIG. 2 omits the buttonhole 6 provided on the outside belt portion 2 and the eye 7 attached to the outside belt portion 2 from illustration.

As shown in FIG. 2, the first embodiment of the ladies' pants 1 has a tuck (flush) 30 provided at a rear side of an outer fold (outside panel) 34*a* so as to extend vertically. A slide fastener tape Fa is sewn on the tuck 30. As shown FIG. 3, the tuck 30 is made by folded/overlapped portion of a cloth of the outer fold 34*a* at two positions: an outer fold-back part 30*a* and an inner fold-back part 30*b*. Then, a folded and overlapped portion is produced at an area from the fold-back part 30*a* to the fold-back part 30*b*. The folded and overlapped portion is stretched or extended so that the folded portion is able to change its shape in such a range as to make the waist size of the ladies' pants 1 adjustable. As shown in FIG. 3, the folded part is the widest at an upper end or a top of the tuck 30. The folded part tapers from the top to a lower end of the tuck 30 and disappears at the lower end of the tuck 30.

As shown in FIG. 3, one of the pair of the fastener tapes or the left fastener tape Fa is sewn on the outer fold 34*a* at an upper side of the folded/overlapped portion of the tuck 30. Teeth Fb are lined along the fastener tape Fa. The other fastener tape or the right fastener tape Fa is sewn on an inner fold or inside panel (not shown in FIG. 3) of the pants with its teeth Fb geared with the teeth Fb of the one fastener tape Fa. A slider Fc is moved upward and downward to make the teeth Fb and the teeth Fb of the pair of the fastener tapes Fa and Fa geared and ungeared with each other, thereby closing and opening (releasing) the front opening of the ladies' pants.

As shown in FIG. 2, the upper end of the left fastener tape Fa is sewn on the upper end of the outer fold 34*a* via a sliding tape 35 and a rubber tape 35*a* at an inside of a liner or lining of the outside belt portion 2. The sliding tape 35 is held and stitched inside the outside belt portion 2 while inclined outward toward the edge of the outer fold 34*a*. The outside belt portion 2 is provided with the stitched buttonhole 6 (though not shown in the FIG. 2). The buttonhole 6 penetrates part of the sliding tape 35 and the rubber tape 35*a* which are attached inside the outside belt portion 2. Then, the sliding tape 35 and the rubber tape 35*a* are also sewn together when stitching the buttonhole 6.

However, in the first embodiment of the ladies' pants 1, the outer fold side fastener tape (left fastener tape) Fa is supported not only by the sliding tape 35 but also by the rubber tape 35*a*. Therefore, when the folded/overlapped part of the tuck 30 is extended, the left fastener tape Fa can move by a stretching force of the rubber tape 35*a* in accordance with an extension of the tuck 30. Thus, the left fastener tape Fa is never hindered from moving even if the outside belt portion 2 is formed with the stitched buttonhole 6 that sews part of the fastener tape Fa together.

Thus, the part of the fastener tape Fa sewn on the tuck 30 is allowed to be moved when pulled outward toward the edge of the outer fold 34, as shown by an arrow in FIG. 3, within a range of a surplus width (stretchable length) of the folded/overlapped portion. In other words, the folded/overlapped portion of the tuck 30 is extended when the tuck 30 is pulled outward toward the edge of the outer fold 34 via the fastener tape Fa. Then, the fastener tape Fa is capable of outward movement toward the edge of the outer fold 34. In addition, the sliding tape 35 sewn on the outer fold 34 is held and stitched inside the outside belt portion 2 while inclined outward toward the edge of the outer fold 34*a*. Accordingly, when the stitched part of the fastener tape Fa on the tuck 30 moves toward the edge of the outer fold 34*a*, it becomes a movement in a direction to make a room for the sliding tape 35 or loosen it. Consequently, the fastener tape Fa is never hindered from moving.

With the tuck 30, if an external force is applied in direction to lengthen the waistband of the ladies' pants 1, while the front opening is closed by the fastener F by moving up the slider Fc, the waist size of the ladies' pants 1 becomes longer within a range of an extensible length of the folded/overlapped portion of the tuck 30 at an area where the tuck 30 is formed behind the fastener tape Fa. Then, a lower portion of the pants just under the waistband becomes longer, too. Thus, the waist size of the pants or the like is adjusted with the moving cloth so as to match the waist size of a wearer. At the same time, a size just under the waist of the wearer is also adjusted by the movement of the fastener tape Fa via the tuck 3.

In the ladies' pants 1 according to the first embodiment, the inner folded part 30*b* of the tuck 30 may be provided with pleating. The pleating makes firmer and stronger a crease 30*c* of the inner folded part 30*b* of the tuck 30. Consequently, if the fastener tape Fa is pulled toward the edge of the outer fold 2 so as to extend the folded/overlapped portion of the tuck 30, the crease 30*c* of the inner folded part 30*b* of the tuck 30 can be kept as it is without any slack. Thus, it is possible to prevent a disadvantage that the inner folded part 30*b* of the tuck 30 becomes loosened out and protruded. Moreover, the pleating prevents the crease 30*c* from slacking or losing its shape after the ladies' pants 1 is washed or laundered, thereby maintaining its function and effects almost permanently.

A first modified example of the a garment having a waist size adjusting mechanism according to the first embodiment of the invention is described hereafter referring to FIG. 4 and FIG. 5.

As shown in FIG. 4, the first modified example of the garment having the waist size adjusting mechanism 1L according to the first embodiment has the inner folded part 30*b* of the tuck 30 is sewn along the crease 30*c* by a stitch 40 near the crease (folding line) 30*c*. Therefore, if the fastener tape Fa is pulled toward the edge of the outside belt portion 2 so as to extend the folded/overlapped portion of the tuck 30, the crease 30*c* of the inner folded part 30*b* of the tuck 30 can be kept as it is without any slack. Thus, it is possible to prevent a disadvantage that the inner folded part 30*b* of the tuck 30 becomes loosened and comes out.

It is preferable to locate a sewing line of the inner folded part 30*b* of the tuck 30 by the stitch 40 at a position 1 mm to 2 mm distant from the crease or folding line 30*c*. If the stitch 40 is provided too far from the crease 30, a shape changeable area by the tuck 30 becomes small. It is not desirable in view of a practical use.

The stitch 40 is provided to sew the inner folded part 30*b* of the tuck 30 up to the lower end of the tuck 30 in the first modified example of the garment having the waist size adjusting mechanism 1L. However, the stitch 40 may be formed only at an area from the upper end of the tuck 30 to a position about three fourth to two third of an entire height lower than the upper end of the tuck 30. Even if the stitch 40 is not provided at a lower area than such position, the same function and effects are supposedly obtained.

As shown in FIG. 5, the fastener tape Fa is sewn along the tuck 30 that is formed as described above. An upper part of the fastener tape Fa is stitched while being angled in a dogleg manner. In other words, the upper end of the outer fastener tape (left fastener tape) Fa is stitched with the upper end part inclined toward an outside. Thus, since the upper end part of the outer fastener tape Fa is stitched while being inclined away from the main part, the outer fastener tape Fa is also capable of moving along with the folded/overlapped portion of the tuck 30 when the folded/overlapped portion of the tuck 30 is extended or stretched. In addition, since no sliding tape is provided, the outer fastener tape Fa is never hindered from moving even if the buttonhole 6 is provided on the outside (outer fold) belt portion 2 and is buttonholed.

The first modified example of the garment having the waist size adjusting mechanism 1L according to the first embodiment describes the case in which the inner folded part 30*b* of the tuck 30 is sewn along the crease 30*c* by the stitch 40 near the crease or folding line 30*c*. However, the inner folded part 30*b* of the tuck 30 may be not sewn as in the garment having the waist size adjusting mechanism 1.

A second modified example of a garment having a waist size adjusting mechanism according to the first embodiment of the invention is described hereafter referring to FIG. 6. As shown in FIG. 6*a*, in the second modified example of the garment having the waist size adjusting mechanism 1M according to the first embodiment, an adjusting cloth 41 of substantially a tubular shape is sewn on an inside of the outer fold instead of providing the tuck. Moreover, as shown in FIG. 6*b*, in the second modified example of the garment having the waist size adjusting mechanism 1M according to the first embodiment, the fastener tape Fa is stitched on the fastener F at an outer fold side. The upper end of the fastener tape Fa is then stitched to the adjusting cloth 41 while being held between an inside of a back fabric of the outside belt portion 2 and the adjusting cloth 4 so as to be inclined toward the outside at an angle.

Specifically, the fastener tape Fa is stitched to the adjusting cloth 41 while being inclined at the angle θ so that its upper part is opened. Thus, a certain amount of size variation is obtained in accordance with a hooking/fastening state of the button 4, which comes out of the second buttonhole 5 of the inside belt portion 3, and the normal buttonhole 6, which is provided on the outside belt portion 2. In case the fastener tape Fa is stitched parallel to the adjusting cloth 41 at an angle θ=zero, there may be generated a bulged portion or a loose part on the pants 1 due to a useless room when the user sits down. However, in the second modified example, the above-mentioned size variation is obtained corresponding to the hooking/fastening state of the button 4 and the normal buttonhole 6 particularly by the stitching of the fastener tape Fa to the adjusting cloth 41. That is, since the fastener tape Fa is stitched to the adjusting cloth 41 so as to have the upper part opened at the angle θ, the size variation is obtained in accordance with the hooking/fastening state of the button 4 and the normal buttonhole 6. Consequently, any useless room is not generated on the pants 1.

As described above, the waist size of the ladies' pants 1 as the garment having the waist size adjusting mechanism according to the first embodiment and the modified examples of the invention has the same appearance as ordinary pants. Moreover, the ladies' pants 1 are enabled to change the waist size continuously. Furthermore, even if the waist size is changed, the fastener tape Fa moves in accordance with the change of the waist size, so that there are no wrinkles or the like around the waist. In addition, when a button 4 comes off, the button 4 can be surely reattached to around a center of the moving cloth by scoop sewing through the round part of the second buttonhole 5. Consequently, the button 4 is easily reattached without any need to seek a position to which the button 4 is stitched.

A manufacturing method of the ladies' pants 1 according to the first embodiment of the invention is described hereafter referring to FIG. 7 to FIG. 10.

As shown in FIG. 7*a*, a moving cloth unit 10 includes a tape cloth 11 of 2.5 cm in width and 3 cm in length, a thin and stiff padding 12 for reinforcement having a same size as the tape cloth 11, an Operon Rubber 13 as an elastic material of 2.5 cm in width and 7 cm in length, and an expansion-preventing or stretching-preventing material 14 of 2.5 cm in width and 11.5 cm in length. As the tape cloth 11 and the expansion-preventing material 14, a lining cloth having a color similar to the outer fabric of the ladies' pants 1 is used. An upper side and a lower side of the expansion-preventing material 14 are made into an overlock-stitched edge 14*a*.

Next, as shown in FIG. 7*b*, the tape cloth 11 is stuck to the thin and stiff padding 12 by an adhesion bond or glue so as to make a glued piece. Then, a circumference of the glued piece is sewn to provide a lock-sewing portion 11, thereby forming a moving cloth 11, 12. On the other hand, a tuck 14*b* of 1.5 cm is formed at a right end side of the expansion-preventing material 14. Then, the expansion-preventing material 14 and the Operon Rubber 13 are laid over the moving cloth 11, 12 that was made by sticking and joining the tape cloth 11 and the thin/stiff padding 12. Thereafter, a line of stitch 11*b* is formed on a left side of such overlaid moving cloth 11, 12, while two lines of stitches 11*b* are formed on a right side of the overlaid moving cloth 11, 12. Thus, the moving cloth 11, 12 is integrally sewn on the expansion-preventing material 14 and the Operon Rubber 13. Then, the button 4 of 1.5 cm in diameter is stitched on a center of the moving cloth 11, 12. As a result, the moving cloth unit 10 is completed. Thus manufactured moving cloth unit 10 is fitted on the belt portion of the ladies' pants 1. At this time, one longitudinal end side of the integrated Operon Rubber 13 and expansion-preventing material 14 is stitched to the belt portion by two lines of stitches 14*c*.

As shown in FIG. 8*a*, the inside belt portion 3 includes an inside belt front fabric 3*d* having a folded-back/facing portion 3*a*. A padding 15 is stuck and joined to a whole backside of the inside belt front fabric 3*d* via an adhesive or glue. An eyelet buttonhole 5 as a second buttonhole is formed to penetrate and pass through the padding 15. Moreover, a reinforcing pad or stiffener sheet 16 is stuck and joined on the padding 15 by an adhesion bond or glue so that the reinforcing pad 16 borders a round hole 5*a* of the eyelet buttonhole 5. An inside belt folded-back portion or inside belt facing 3*b* is stitched to the inside belt front fabric 3*d* with one longitudinal end (left end) located at the same border as the reinforcing pad 16. As shown in FIG. 5*b*, the moving cloth unit 10 is fitted on the inside belt portion 3 in a reversed manner. That is, the moving cloth unit 10 is fitted such that the button 4 thereon comes out at a far side.

As specific procedures, the button 4 is fitted first into the eyelet buttonhole 5 so that the button 4 is located at a position of the round part 5*q* of the eyelet buttonhole 5. Next, the left end of the expansion-preventing material 14 is sewn to the folded-back/facing portion 3*a* by a stitch 18 that is provided at a part going beyond a folded-back line or return line 3*c* of the folded-back/facing portion 3*a*. Then, as shown in FIG. 5*c*, an edge of the Operon Rubber 13 and the expansion-preventing material 14 joined as one body is sewn on the folded-back inside belt folding 3*b* by two lines of stitches 14*c*, while the tuck 14*b* of 1.5 cm being formed at the right end side of the expansion-preventing material 14.

Then, the inside the folding back part 3*a* is folded in the folding back line 3*c* and is sewn on the inside belt facing portion 3*b*. Thus, the inside belt portion 3 is completed. At this time, the stitch 18 and the two lines of the stitches 14*c* are presented or visible at the back side of the inside belt portion 3 and never seen from front side. Therefore, the appearance of the ladies' pants 1 according to the first embodiment is improved. Moreover, when the moving cloth unit 10 is pulled, the elastic material 13 thereof is stretched accordingly. Then, the moving cloth unit 10 is contracted by an urging force of the elastic material 13 at once. At this time, the reinforcing pad 16 prevents wrinkles from being generated on a front side 3*d* of the inside belt portion 3. Consequently, except shown in FIG. 5*a*, there are various modified examples in sticking and joining the reinforcing pad on the inside belt portion 3.

Referring to FIG. 9, hereunder described are reinforcing pads provided on inside belt portions of the ladies' pants 1 according to several modified examples of the first embodiment of the invention. In FIG. 9*a* to FIG. 9*e*, the padding 15 stuck and joined to the back side of the inside belt front fabric 3*d* is omitted from illustration.

As shown in FIG. 9*a*, in a first modified example of an inside belt portion 3A, a reinforcing pad 16A is not stuck to the rear side of the inside belt front fabric 3*d* but to the rear side of the inside belt facing portion 3*b* by an adhesive (bond, glue or the like). Thus, as shown in FIG. 8, when the moving cloth unit 10 is stitched on the inside belt portion 3*b*, the reinforcing pad 16A is also stitched together with the moving cloth unit 10. Consequently, the moving cloth unit 10 becomes more durable and heavy-duty. As shown in FIG. 9*b*, in a second modified example of an inside belt portion 3B, a reinforcing pad 16B has a length (vertical dimension) a little larger than the reinforcing pad 16A. Then, the reinforcing pad 16B is stuck and joined to the rear side of the inside belt facing portion 3*b* by an adhesive so as to cover even a seam allowance of the rear side of the inside belt facing portion 3*b*.

As shown in FIG. 9*c*, in a third modified example of an inside belt portion 3C, a reinforcing pad 16C has a length (vertical dimension) about twice as large as the reinforcing pads 16A. The reinforcing pad 16C is stitched and joined to the inside belt portion 3 by an adhesive over an area from the rear side of the inside belt front fabric 3*d* to the rear side of the inside belt facing portion 3*d*. Consequently, a reinforcing effect is doubled. Moreover, the reinforcing pad 16C is also sewn on the inside belt portion 3 together with the moving cloth unit 10 whether the moving cloth unit 10 is stitched to the inside belt facing portion 3*b* or to the inside belt front fabric 3*d*. Accordingly, the moving cloth unit 10 becomes more durable. As shown in FIG. 9*d*, in a fourth modified example of an inside belt portion 3D, a reinforcing pad 16D has a length (vertical dimension) a little larger than the reinforcing pad 16C. Then, the reinforcing pad 16D is stuck and joined to the inside belt portion 3 by an adhesive so as to cover even seam allowances of the rear sides of the inside belt facing portion 3*b* and the inside belt front fabric 3*d*.

As shown in FIG. 9*e*, in a fourth modified example of an inside belt portion 3E, a reinforcing padding 16E has a length (vertical dimension) a little larger than the reinforcing pad 16 shown in FIG. 8. Then, the reinforcing pad 16E is stuck and joined to the inside belt portion 3 by an adhesive so as to cover even a seam allowance of the rear side of the inside belt front fabric 3*d*.

Figure 10A:
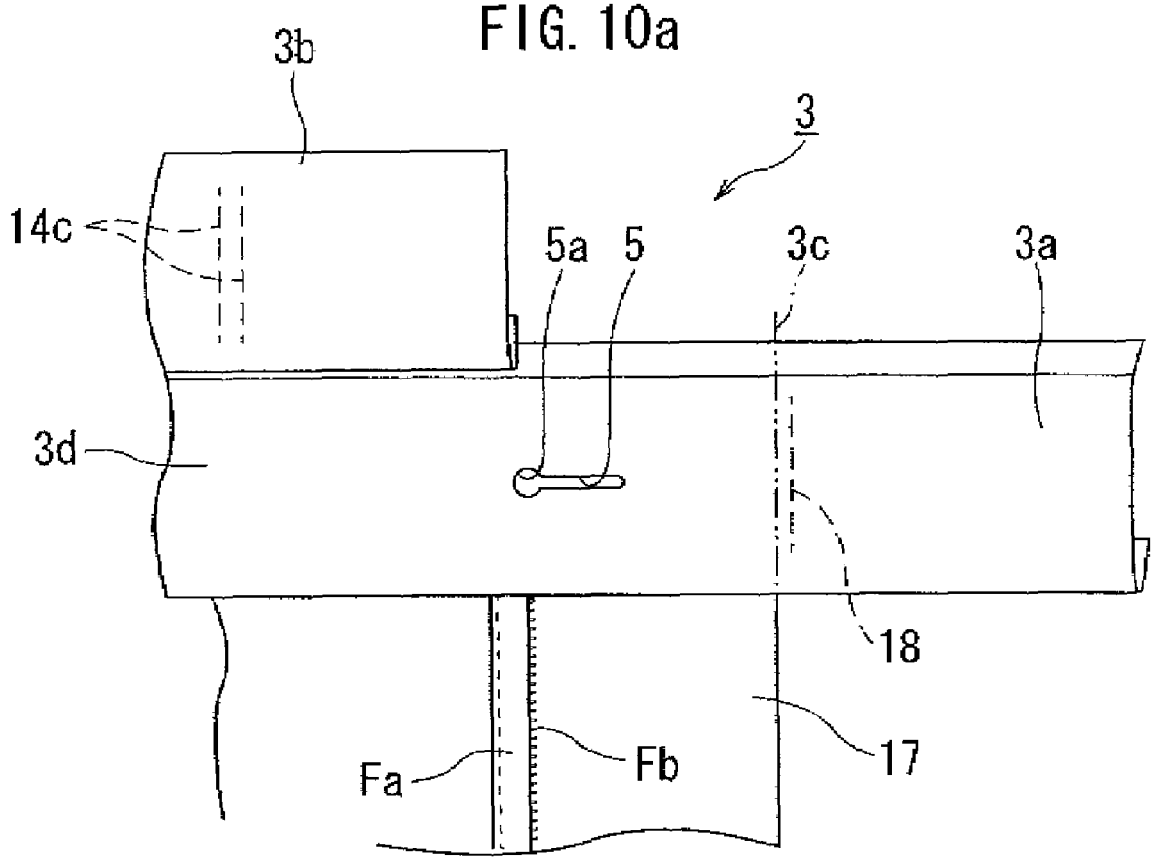
FIGS. 10*a* and 10*b* are drawings showing the inside belt portion, seen from a front side, of the garment having the waist size adjusting mechanism according to the first embodiment of the invention.

FIG. 10 illustrates a view of the inside belt portion 3 shown in FIG. 8 while seen from a front side thereof. As shown in FIG. 10*a*, the moving cloth unit 10 (not shown in FIG. 10) has a leading end portion, which goes beyond the folded-back line 3*c* of the folded-back/facing portion 3*a*, sewn on the folded-back/facing portion 3*a* by the stitch 18. Moreover, the edge of the Operon Rubber 13 and the expansion-preventing material 14 is sewn on the folded-back inside belt facing portion 3*b* by the two lines of the sewing machine stitches 14*c*.

Figure 10B:
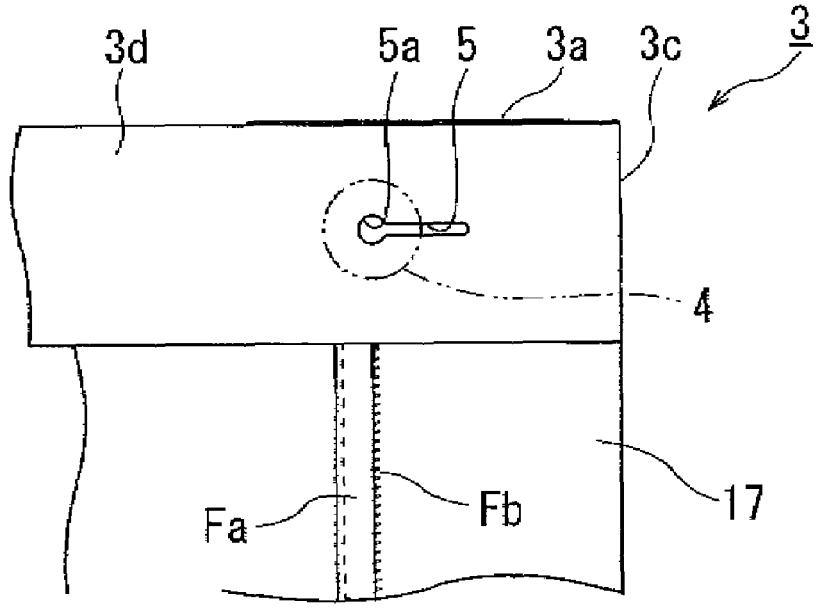

Next, as shown in FIG. 10*b*, the folded-back/facing portion 3*a* is folded back at the folded-back line 3*a* and is then sewn on the inside belt facing portion 3*b*. Accordingly, the inside belt portion 3 is completed. Thus, the stitch 18 and the two lines of the stitches 14*c* are presented at the rear side of the inside belt portion 3 and never seen from the front side. Consequently, the appearance of the ladies' pants 1 according to the first embodiment is improved.

Figure 11A:
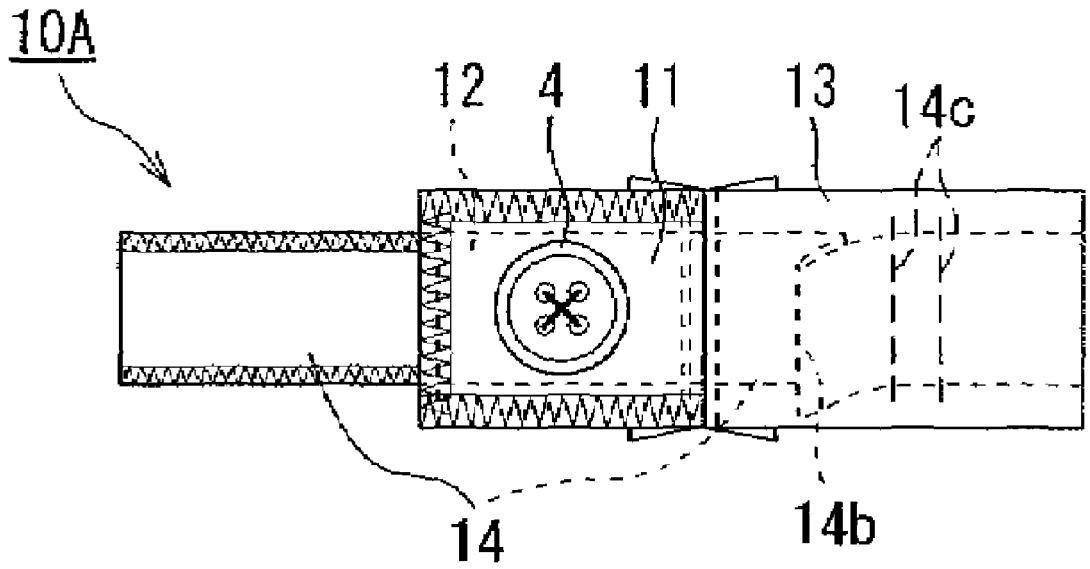
FIGS. 11*a* and 11*b* are drawings showing modified examples of moving cloth units provided on the inside belt portion according to the first embodiment of the invention.

Described hereafter referring to FIG. 11 are modified examples of moving cloth units provided on the inside belt portion 3 according to the first embodiment of the invention. As shown in FIG. 11*a*, in a moving cloth unit 10A according to a first modified example of the first embodiment, a length (horizontal dimension) of an expansion-preventing material 14 is smaller than the moving cloth 11, 12 and the Operon Rubber 13 as the elastic material. Moreover, the Operon Rubber 13 and the moving cloth 11, 12 are not overlapped with each other. On the other hand, the Operon Rubber 13 and the moving cloth 11, 12 are butted or abutted. Then, the Operon Rubber 13 and the moving cloth 11, 12 are stitched and fixed on the expansion-preventing material 14, respectively.

Figure 11B:
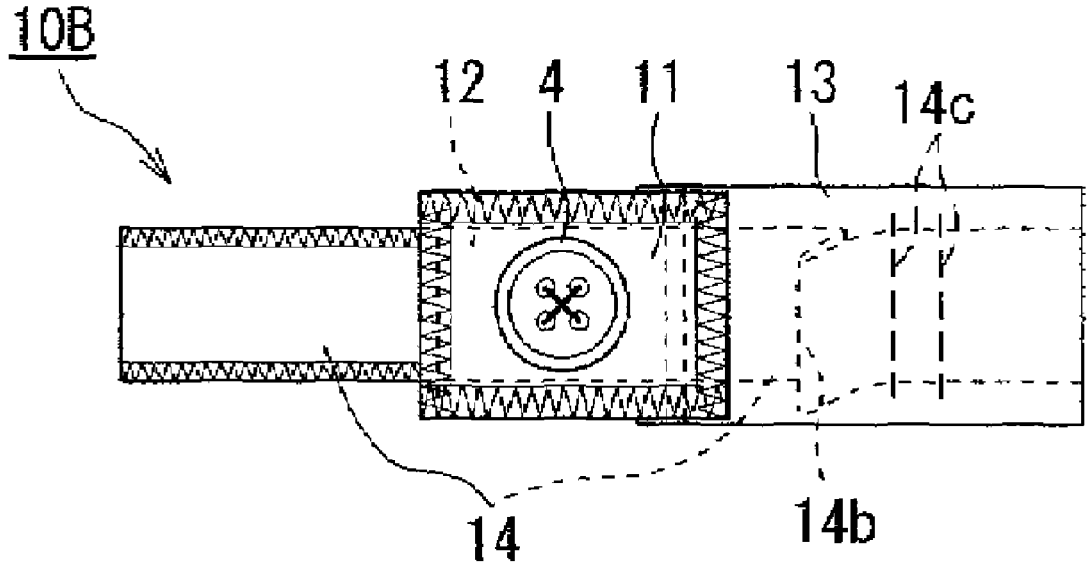

As shown in FIG. 11*b*, in a moving cloth unit 10B according to a second modified example of the first embodiment, a length (horizontal dimension) of an expansion-preventing material 14 is also shorter than the moving cloth 11, 12 and the Operon Rubber 13 as the elastic material. The moving cloth 11, 12 and the Operon Rubber 13 have their facing longitudinal ends overlapped and sewn with each other.

Figure 12A:
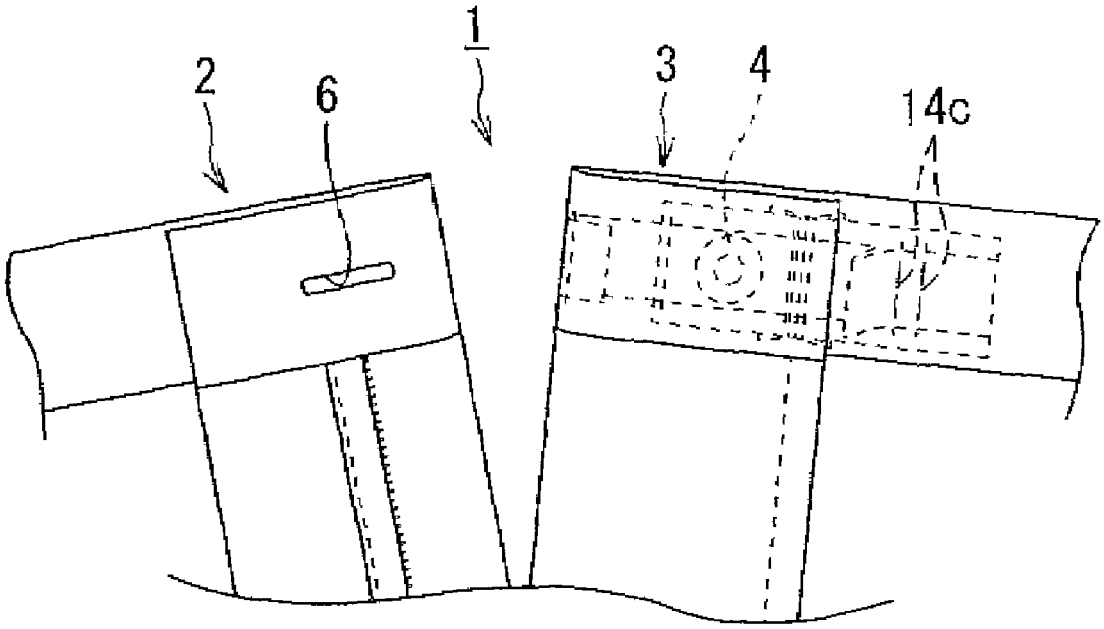
FIG. 12*a* is a drawing of a front opening, seen from a rear side, in a released state in the garment having the waist size adjusting mechanism according to the first embodiment of the invention.

A modified examples of an outside belt portion and an inside belt portion of the garment having the waist size adjusting mechanism according to the first embodiment of the invention is described hereafter referring to FIG. 12. As shown in FIG. 12*a*, in the ladies' pants 1 as the garment having the waist size adjusting mechanism according to the first embodiment, the folded-back portion or a facing portion is provided on each of the end portions of the outside belt portion 2 and the inside belt portion 3. Then, the facing portion of each of the outside belt portion 2 and the inside belt portion 3 is folded back to be doubled. Thereafter, the buttonhole 6 is provided on the outer fold. Moreover, the moving cloth unit 10 is stitched on the facing portion of the inside belt portion 3 by two lines of the stitches 14*c*. Then, the button 4 is protruded or taken out outside (front side) from the second buttonhole (not shown in FIG. 12).

Figure 12B:
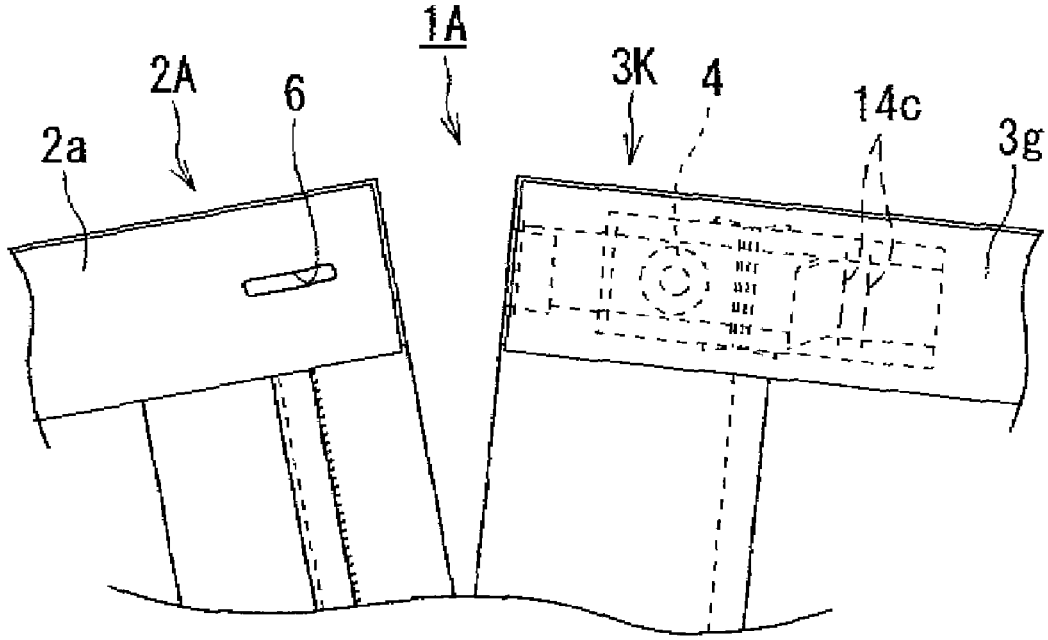
FIG. 12*b* is a drawing of a first modified example of a front opening, seen from a rear side, in a released state in the garment having the waist size adjusting mechanism according to the first embodiment of the invention.

In contrast, as shown in FIG. 12*b*, in the ladies' pants 1A as the garment having the waist size adjusting mechanism according to a modified example of the first embodiment, separate cloth or fabric 2*a* is joined on an outside belt portion 2A so that they constitute a doubled structure or doubled layers. Moreover, a separate cloth or fabric 3*g* is joined on an inside belt portion 3K so that they constitute a doubled structure or doubled layers. Then, the buttonhole 6 is formed on the outer fold composed of the doubled outside belt portion 2A and the cloth 2*a*. Moreover, the moving cloth unit is stitched on the cloth 3*g* joined on the inside belt portion 3K by two lines of the stitches 14*c*. Thereafter, the button 4 is protruded or taken out to an outside (front side) from the second buttonhole (not shown in FIG. 12).

As described above, there are various ways of manufacturing methods of the outside belt portion and the inside belt portion of the garment having the waist size adjusting mechanism. Still, in each of the manufacturing methods, the two lines of the stitches 14*c* are presented only at the rear side and never seen from the front side. Consequently, the outside appearance of the ladies' pants 1 according to the first embodiment is never spoiled or affected.

In the ladies' pants 1, 1A, 1B, 1C, 1E according to the first embodiment, the second buttonhole 5 is the eyelet buttonhole in each of the inside belt portion 3 and the inside belt portions 3A, 3B, 3C, 3D, 3D, 3E, 3K according to the modified examples. Moreover, it is set such that the round part 5*a* of the second buttonhole 5 is located at a position corresponding to around the center of the moving cloth 11, 12 when the moving cloth 11, 12 returns to the original position by the elastic force of the elastic material 13. Then, the button 4 can be stitched by scoop sewing through the round part 5*a* of the second buttonhole 5. Thus, the button 4 is capable of being surely reattached to around the center of the moving cloth 11, 12 even if the button 4 comes off or is detached.

Second Embodiment

Figure 13A:
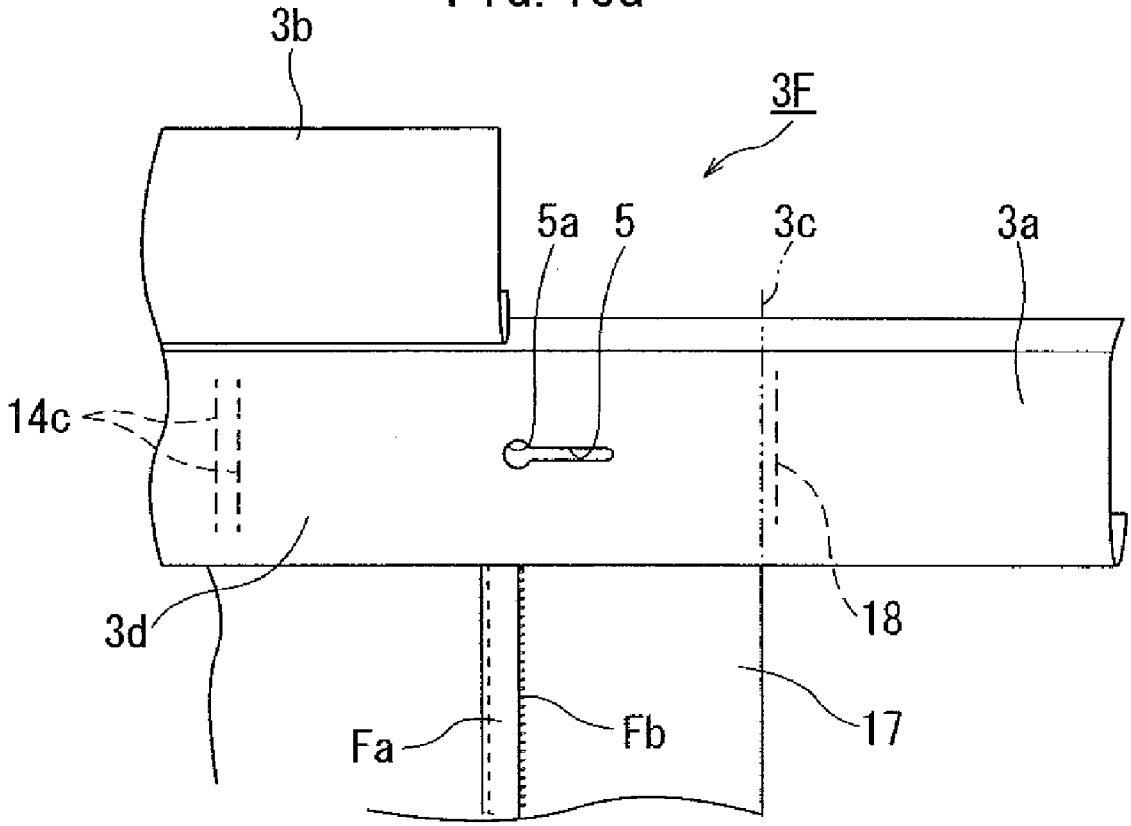
Figure 13B:
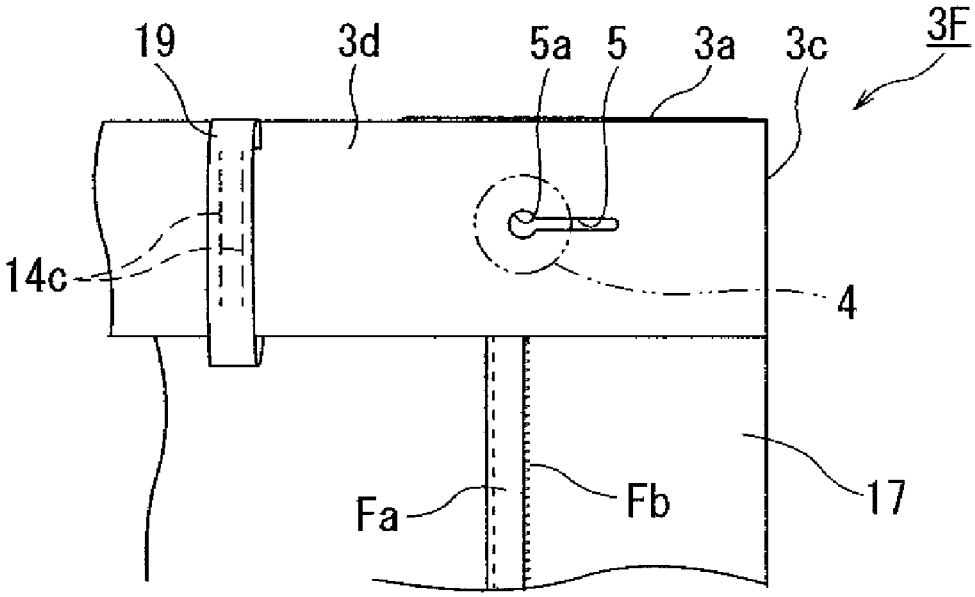
FIG. 13*b* shows the inside belt portion in a finished and sewn state.

A garment having a waist size adjusting mechanism according to a second embodiment of the invention is described hereafter referring to FIG. 13. FIGS. 13*a* and 13*b* are drawings showing an inside belt portion of the garment having the waist size adjusting mechanism according to the second embodiment of the invention that is seen from a front side. The structure except the inside belt portion of the garment having the waist size adjusting mechanism according to the second embodiment of the invention is similar to the ladies' pants 1 as the garment having the waist size adjusting mechanism according to the first embodiment. Therefore, the same reference character is used to show the same element and a description of the same elements is omitted to avoid redundancy.

As shown in FIG. 13*a*, an inside belt portion 3F of the garment having the waist size adjusting mechanism according to the second embodiment has almost the same structure as the inside belt portion 3 according to the first embodiment. The inside belt portion 3F is different from the inside belt portion 3 in that the two lines of the stitches 14*c* for sewing the edges of the Operon Rubber 13 and the expansion-preventing material 14 of the moving cloth unit 10 (not shown in FIG. 13) is provided not on the folded-back inside belt facing portion 3*b* but on inside belt front fabric 3*d*.

Thus, as shown in FIG. 13*a*, the two lines of the stitches 14*c* are presented at the front side. However, as shown in FIG. 13*b*, according to the second embodiment, a belt loop 19 is attached on the inside belt portion 3F so as to cover and hide wholly the two lines of the stitches 14*c*. Thus, the two lines of the sewing machine stitched 14 are never seen outside. Therefore, the outside appearance of the ladies' pants 1 according to the second embodiment is never spoiled or affected.

As described above, the ladies' pants 1 as the garment having the waist size adjusting mechanism according to the second embodiment has the same appearance as the ordinary pants. Moreover, the second embodiment of the ladies' pants is enabled to continuously change the waist size. Furthermore, the fastener tape moves in accordance with the change of the waist size. Consequently, there are no wrinkles produced around the waist of the pants. In addition, the button 4 is allowed to be stitched by the scoop sewing through the round part 5*a* of the second buttonhole 5 even if the button 4 is detached. Thus, the button 4 can be surely reattached at around the center of the moving cloth. Accordingly, there is no need to seek a position where the button 4 is to be reattached. As a result, the button 4 can be easily reattached.

Third Embodiment

Figure 14A:
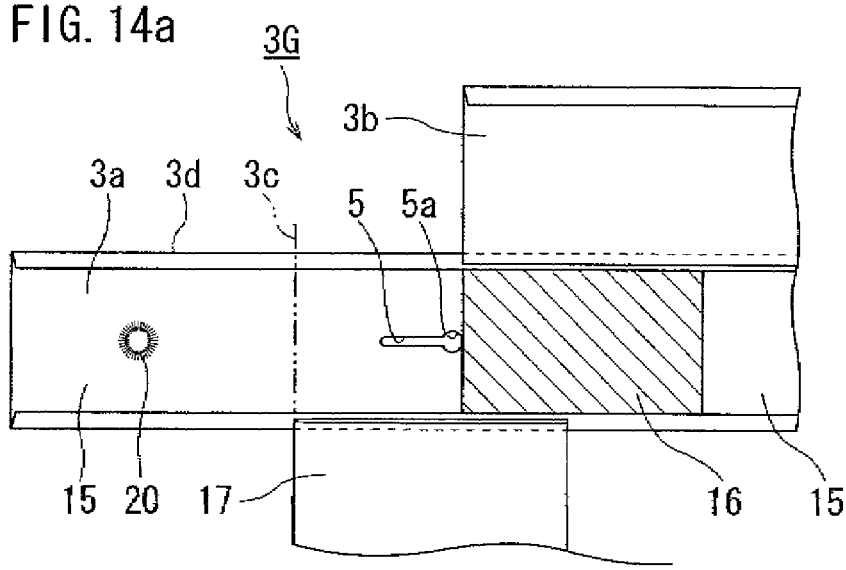
FIGS. 14*a*, 14*b* and 14*c* are drawings depicting a process of fabricating an inside belt portion, seen from a rear side, in a garment having a waist size adjusting mechanism according to a third embodiment of the invention.
Figure 14B:
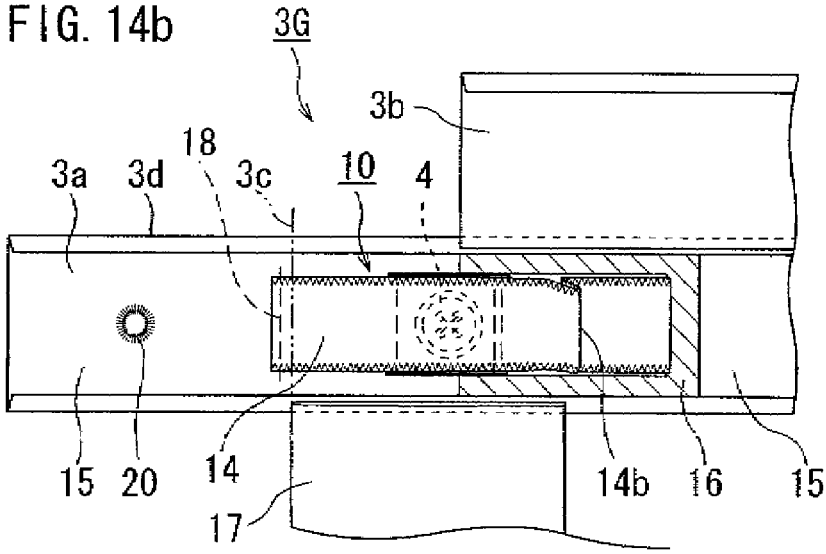
Figure 14C:
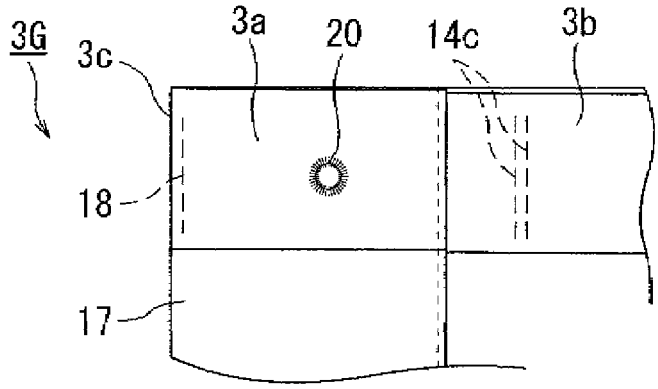

A garment having a waist size adjusting mechanism according to a third embodiment of the invention is described hereafter referring to FIG. 14. FIGS. 14*a*, 14*b* and 14*c* are explanatory drawings showing a manufacturing method of an inside belt portion of the garment having the waist size adjusting mechanism according to the third embodiment of the invention.

As shown in FIG. 14*a*, a structure of an inside belt portion 3G of the garment having the waist size adjusting mechanism according to the third embodiment is almost the same as the structure of the inside belt portion 3 of the garment having the waist size adjusting mechanism 1 according to the first embodiment shown in FIG. 8*a*. The inside belt portion 3G is different from the inside belt portion 3 in that a stitched round hole 20 as a through hole is provided on the folded-back/facing portion 3*a*. Then, as shown in FIG. 14*b*, the moving cloth unit 10 is stitched inside out, namely such that the button 4 is protruded or taken out to a far side or the front side in the same manner as the inside belt portion 3 according to the first embodiment.

In specific procedures, the button 4 is fitted first into the eyelet buttonhole 5 so as to be located at a position corresponding to the round part 5*a* of the eyelet buttonhole 5. Next, the left end of the expansion-preventing material 14 has a portion, which goes beyond a folded-back line 3*c* of the folded-back/facing portion 3*a*, sewn on the folded-back/facing portion 3*a* by the stitch 18. Then, as shown in FIG. 14*c*, the edge of the integrated sheet of the Operon Rubber 13 and the expansion-preventing material 14 is sewn on the inside belt facing portion 3*b* by two lines of the sewing machine stitches 14*c*, while the tuck 14*b* of 1.5 cm wide is formed at a right side thereof.

Thereafter, the folded-back/facing portion 3*a* is folded back at the folded-back line 3*c* and sewn on the inside belt portion 3*b*. Thus, the inside belt portion 3G according to the third embodiment is completed. Here, the stitched round hole 20 provided on the folded-back facing portion 3*a* is set such that it comes just at a position of the round part 5*a* of the eyelet buttonhole 5. Accordingly, even if the button 4 is detached or comes off, the button 4 can be reattached by passing a needle through the stitched round hole 20 and the round part 5*a* of the second buttonhole 5. At this time, the stitched round hole 20 as a through hole is located at the position corresponding to the round part 5*a* of the second buttonhole 5 and serves as a position guide to make the need pass through. Consequently, it is easy to reattach the button 4 to the inside belt portion 3G with more durability.

Moreover, the stitch 18 and the two lines of the stitches 14*c* are presented or seen at the rear side of the inside belt portion 3G and never seen from the front side. Consequently, the appearance of the garment having the waist size adjusting mechanism according to the third embodiment is improved. As described above, the garment with the waist size adjusting mechanism according to the third embodiment has the same appearance as the ordinary garment. Moreover, the garment is capable of continuously changing the waist size while keeping the good appearance. Furthermore, the garment enables the button to be reattached easily with sufficient durability, even if the button 4 comes off or is detached.

The third embodiment is described on the case in which the stitched round hole 20 is provided as the through hole that is formed on the folded-back/facing portion 3*a*. However, a ring hole made of a metal ring or a metal eyelet may be provided as the through hole instead of the stitched round hole 20.

Fourth Embodiment

Figure 15A:
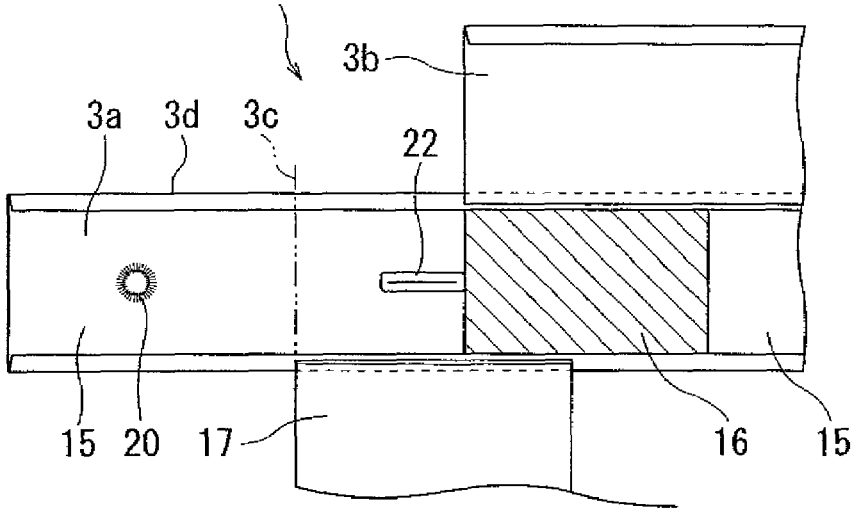
FIGS. 15*a*, 15*b* and 15*c* are drawings depicting a process of fabricating an inside belt portion, seen from a rear side, in a garment having a waist size adjusting mechanism according to a fourth embodiment of the invention.
Figure 15B:
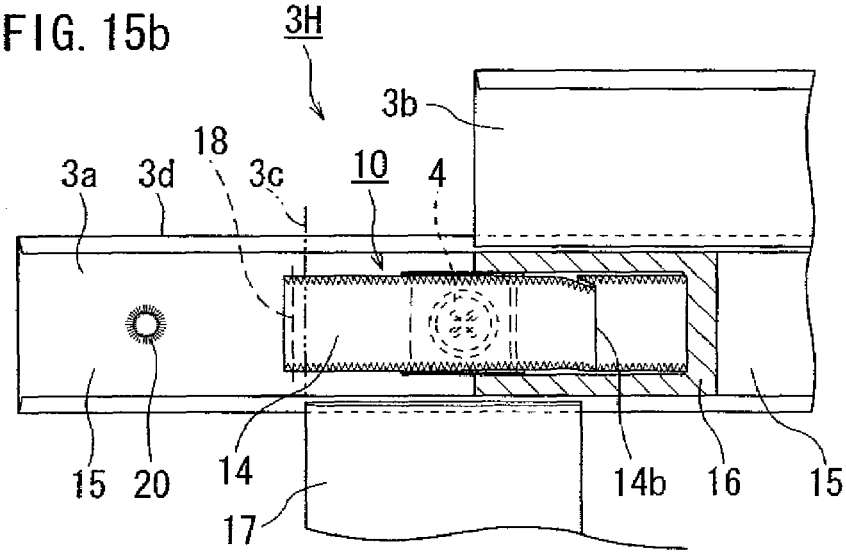
Figure 15C:
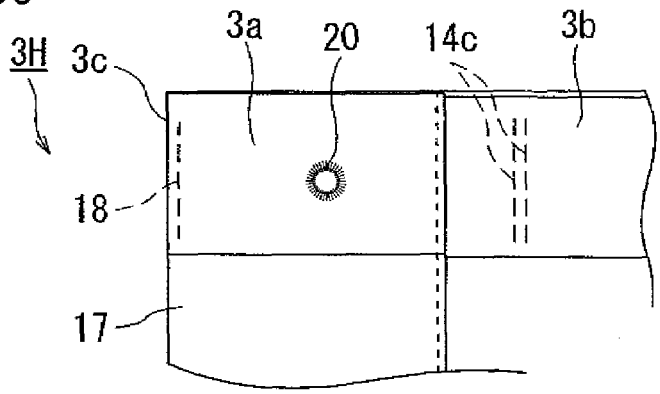
Figure 16A:
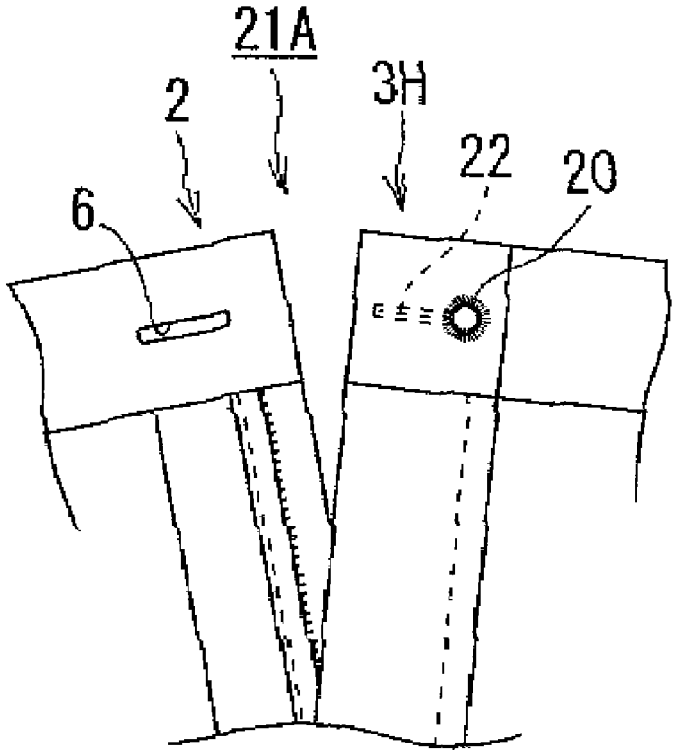
FIG. 16*a* is a partially enlarged drawing of a slide fastener, seen from a rear side, in a released or opened state in the garment having the waist size adjusting mechanism according to the fourth embodiment of the invention.
Figure 16B:
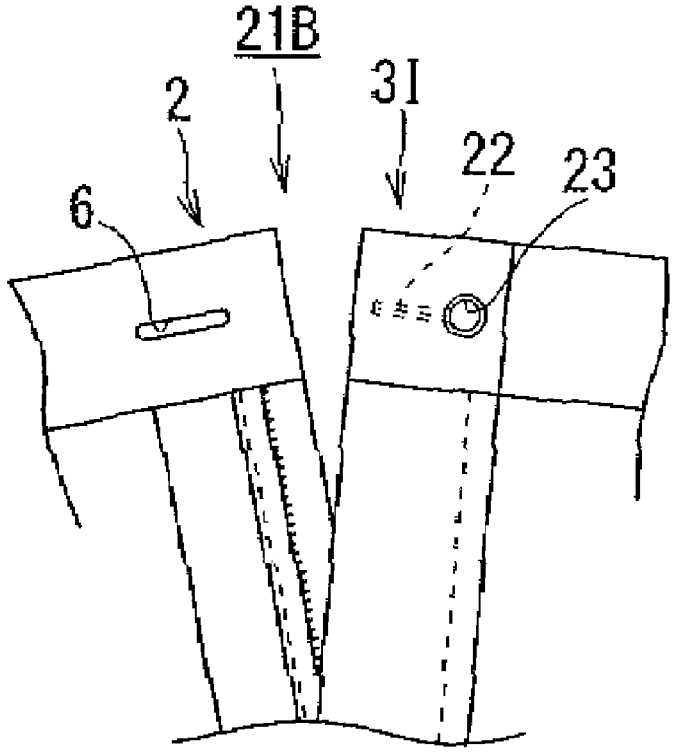
FIG. 16*b* is a drawing of a first modified example of a slide fastener, seen from a rear side, in a released or opened state in the garment having the waist size adjusting mechanism according to the fourth embodiment of the invention.

A garment having a waist size adjusting mechanism according to a fourth embodiment of the invention is described hereafter referring to FIG. 15 and FIG. 16. FIGS. 15*a*, 15*b* and 15*c* are explanatory drawings showing a manufacturing method of an inside belt portion of the garment having the waist size adjusting mechanism according to the fourth embodiment of the invention. FIG. 16*a* is a partially enlarged view showing the garment having the waist size adjusting mechanism according to the fourth embodiment of the invention, while a fastener is opened so as to show a rear side thereof. FIG. 16*b* is a partially enlarged view showing a garment having a waist size adjusting mechanism according to a modified example of the fourth embodiment of the invention, while a fastener is opened so as to show a rear side thereof.

As shown in FIG. 15*a*, a structure of the inside belt portion 3H of the garment having the waist size adjusting mechanism according to the fourth embodiment is almost the same as the structure of the inside belt portion 3G of the garment having the waist size adjusting mechanism 1 according to the third embodiment shown in FIG. 14*a*. The inside belt portion 3H is different from the inside belt portion 3G in that a second buttonhole is not composed of an eyelet buttonhole but of a straight hole 22. Then, as shown in FIG. 15*b*, the moving cloth unit 10 is attached in a reverse state, namely such that the button 4 is protruded or taken out to a far side or a front side in the same way as the inside belt portion 3G according to the third embodiment.

As specific procedures, the button 4 is fitted first into the straight hole 22. Next, the left end of the expansion-preventing material 14 has a portion, which goes beyond the folded-back line 3*c* of the folded-back/facing portion 3*a*, sewn on folded-back/facing portion 3*a* by the stitch 18. Then, as shown in FIG. 15*c*, the edge parts of the Operon Rubber 13 and the expansion-preventing material 14 are sewn on the folded-back inside belt facing portion 3*b* by two lines of the stitches 14*c*, while the tuck 14*b* of 1.5 cm wide is formed at a right hand side thereof.

Thereafter, the folded-back facing portion 3*a* is folded back at the folded-back line 3*c* to be sewn on the inside belt facing portion 3*b*. Thus, the inside belt portion 3G according to the fourth embodiment is completed. Here, the stitched round hole 20 is provided or set on the folded-back/facing portion 3*a* such that it comes exactly to a position corresponding to nearly a center of the moving cloth 11, 12 at a rear side of the straight hole 22 by an elastic force of the elastic material 13 when the moving cloth 11, 12 comes back to its original position. Accordingly, even if the button 4 comes off or is detached, the button 4 can be reattached by passing a needle through the stitched round hole 20 as the through hole and the straight hole 22. At this time, the stitched round hole 20 is located at the position corresponding to nearly the center of the moving cloth 11, 12. Accordingly, the stitched round hole 20 serves as a guide in passing the needle through the straight hole 22. Consequently, the button 4 is enabled to be stitched more easily and more durably.

Moreover, as shown in FIG. 15*c* and FIG. 16*a*, the stitched round hole 20, the stitch 18 and the two lines of the stitches 14*c* are presented and shown at the rear side of the inside belt portion 3H and never seen from the front side. Consequently, the appearance of the garment having the waist size adjusting mechanism 21A according to the fourth embodiment is improved. As described above, the garment with the waist size adjusting mechanism 21A according to the fourth embodiment has the same appearance as the ordinary garment. Moreover, the garment is able to continuously change the waist size while keeping the appearance good. Furthermore, the garment enables to reattach the button more easily and more durably even if the button is detached.

In an inside belt portion 3I of a garment 21B having a waist size adjusting mechanism according to a modified example of the fourth embodiment, a ring hole 23 as a through hole made of a metal ring or a metal eyelet is provided at a position corresponding to the stitched round hole 20 shown in FIG. 15*a*. Moreover, as shown in FIG. 16*b*, in the garment 21B having the waist size adjusting mechanism according to the modified example of the fourth embodiment, the ring hole 23 is provided or set such that it comes just to a position corresponding to around a center of the moving cloth 11, 12 at a rear side of the straight hole 22 by the elastic force of the elastic material 13 when the moving cloth 11, 12 returns to the original position.

Thus, even if the button 4 comes off, the button 4 can be reattached by passing a needle through the ring hole 23 and the straight hole 22. At this time, the ring hole 23 as a through hole is located at the position corresponding to nearly the center of the moving cloth 11, 12. Thus, the ring hole 23 serves as a guide when the needle is passed through the straight hole 22. Therefore, the button 4 is allowed to be stitched more easily and more durably on the inside belt portion 3I. As described above, the garment 21B having the waist size adjusting mechanism according to the modified example of the fourth embodiment has the same appearance as the ordinary garment. Moreover, the garment is capable of continuously changing the waist size while keeping the appearance good. Furthermore, the button can be reattached more easily and more durably even if the button comes off or is detached.

Fifth Embodiment

A garment having a waist size adjusting mechanism according to a fifth embodiment of the invention is described hereafter referring to FIG. 17 to FIG. 21.

Figure 17A:
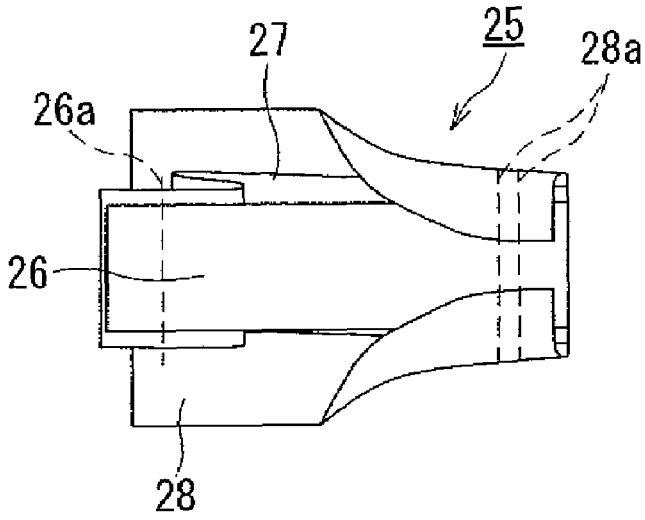
FIGS. 17*a*, 17*b* and 17*c* are drawings depicting a process of fabricating an inside belt portion, seen from a rear side, in a garment having a waist size adjusting mechanism according to a fifth embodiment of the invention.
Figure 17B:
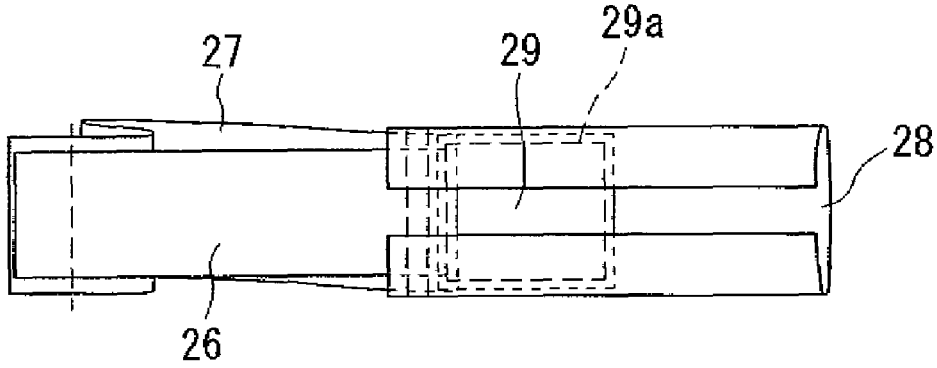
Figure 17C:
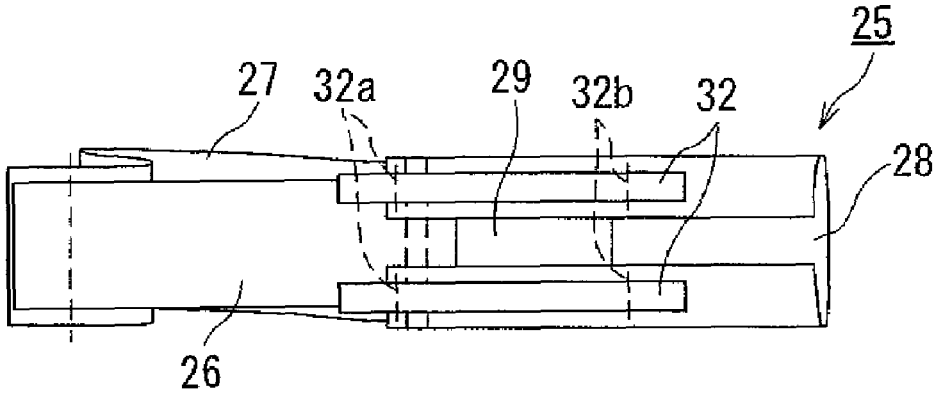
Figure 18A:
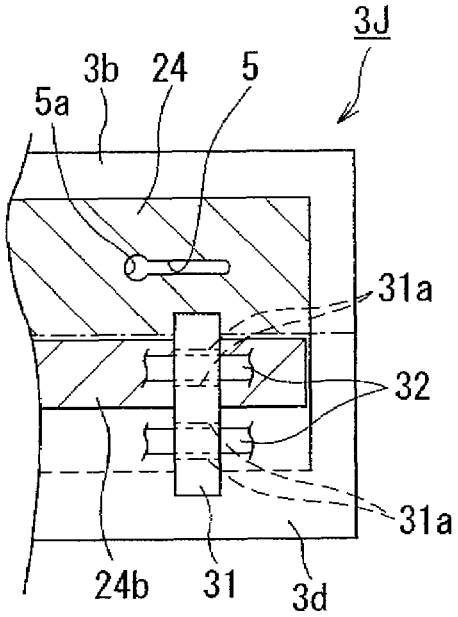
FIG. 18*a* is a drawing showing a way of attaching or fitting a run-off (blow-out) prevention tape to an inside belt part, while illustrating them in an expansion plan view from a rear side, in a garment having a waist size adjusting mechanism according to the fifth embodiment of the invention.
Figure 18B:
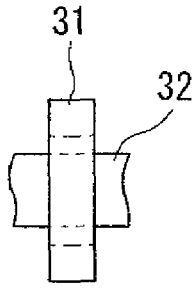
FIG. 18*b* is a drawing showing a first modified example of a run-off prevention tape in the garment having the waist size adjusting mechanism according to the fifth embodiment.
Figure 18C:
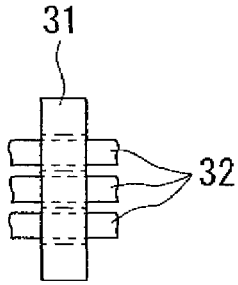
FIG. 18*c* is a drawing showing a second modified example of a run-off prevention tape in the garment having the waist size adjusting mechanism according to the fifth embodiment.
Figure 19A:
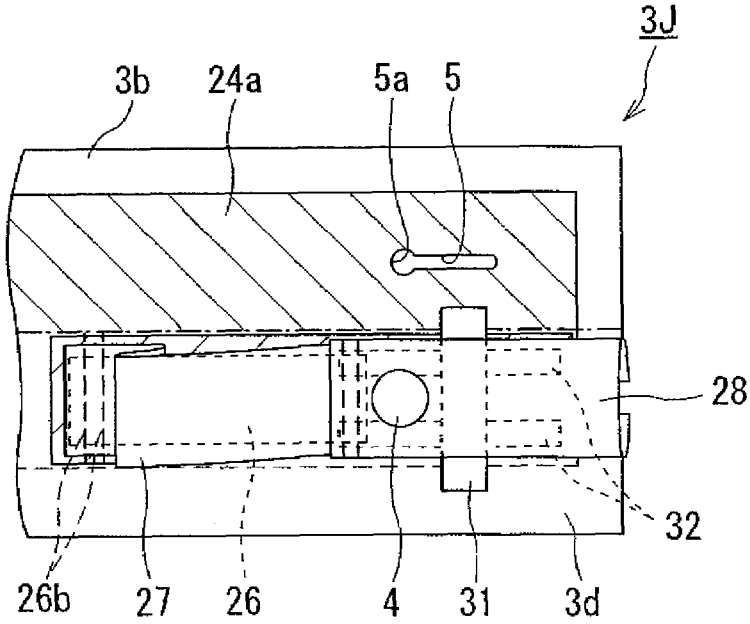
FIG. 19*a* is a drawing showing a moving cloth unit attached to the inside belt portion, while illustrating the inside belt portion in an expansion plan view from a rear side, in the garment having the waist size adjusting mechanism according to the fifth embodiment of the invention.
Figure 19B:
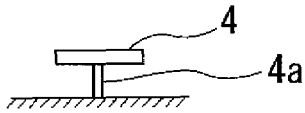
FIG. 19*b* is a drawing showing a height of a neck-wrapping or base-winding of a button in the garment having the waist size adjusting mechanism according to the fifth embodiment of the invention.
Figure 20A:
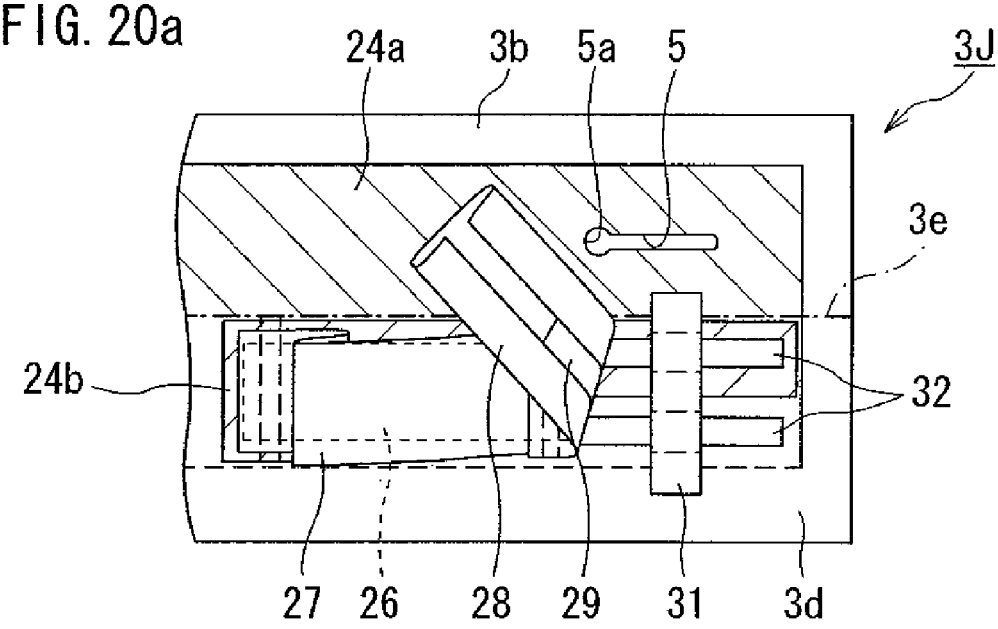
FIG. 20*a* is a drawing showing a relation of the moving cloth unit and the run-off prevention tape, while illustrating the inside belt portion in an expansion plan view from a rear side with the moving cloth unit partially detached, in the garment having the waist size adjusting mechanism according to the fifth embodiment of the invention.
Figure 20B:
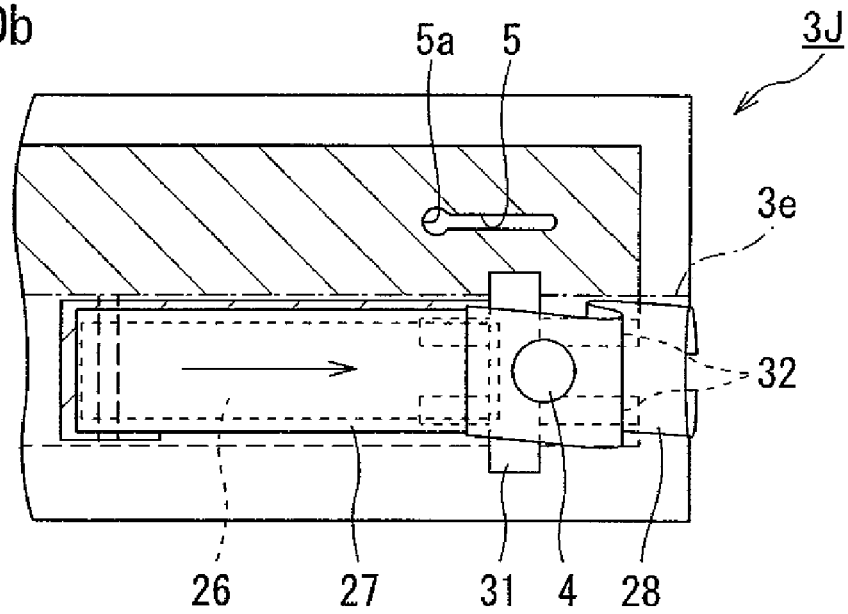
FIG. 20*b* is a drawing showing the moving cloth unit with the button moved against a tension of an elastic material up to a full length of an expansion-preventing member, while illustrating the inside belt portion in an expansion plan view from the rear side.
Figure 20C:
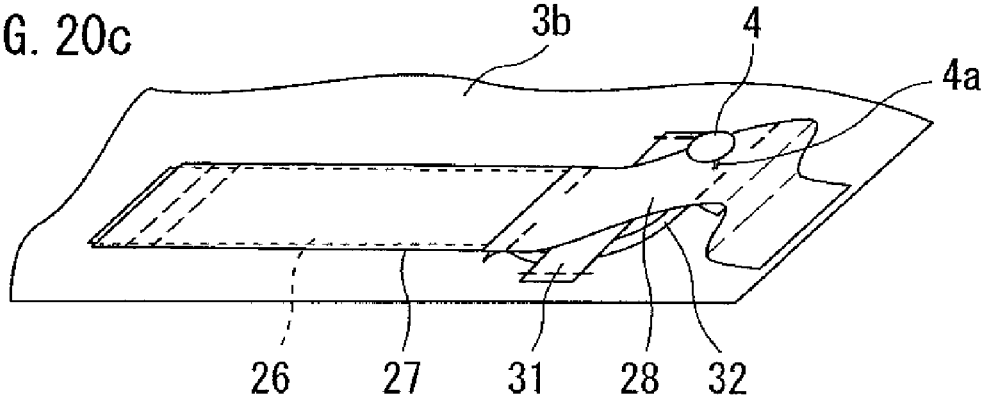
FIG. 20*c* is a perspective view of FIG. 20*b*.
Figure 21A:
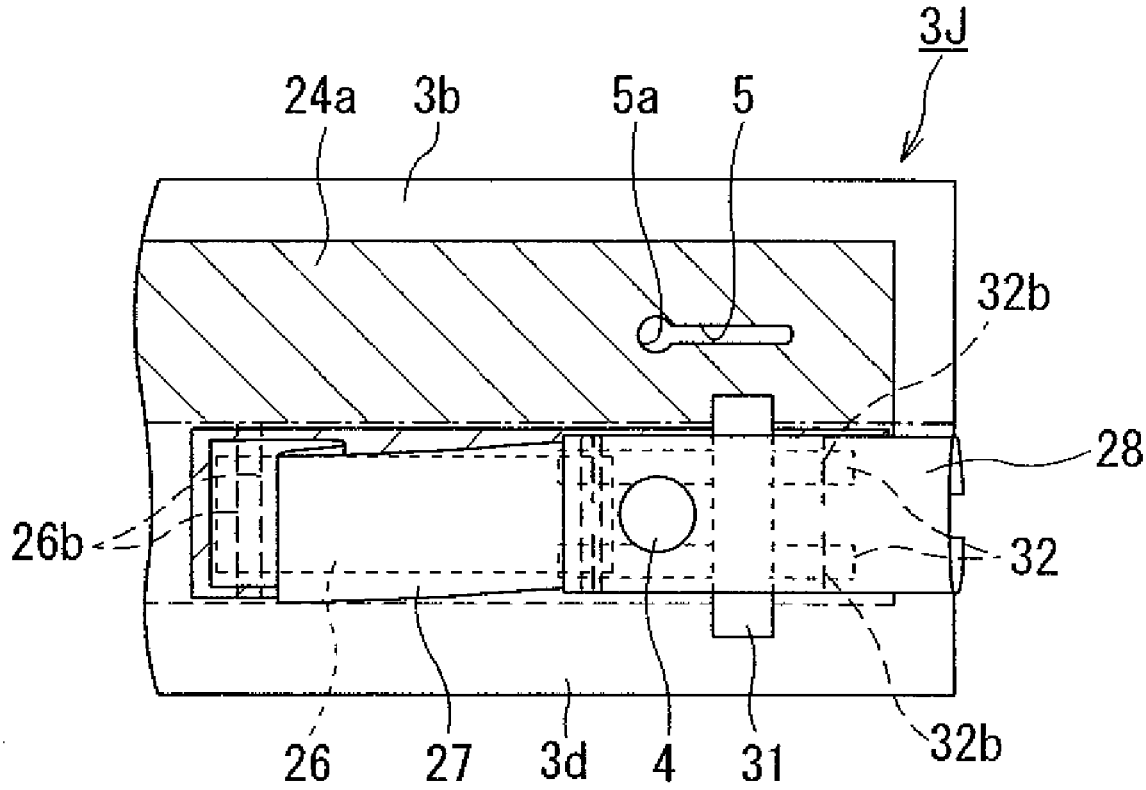
FIG. 21*a* is a drawing showing the run-off prevention tape stitched to the inside belt portion, while illustrating the inside belt portion in an expansion plan view from a rear side, in the garment having the waist size adjusting mechanism according to the fifth embodiment of the invention.
Figure 21B:
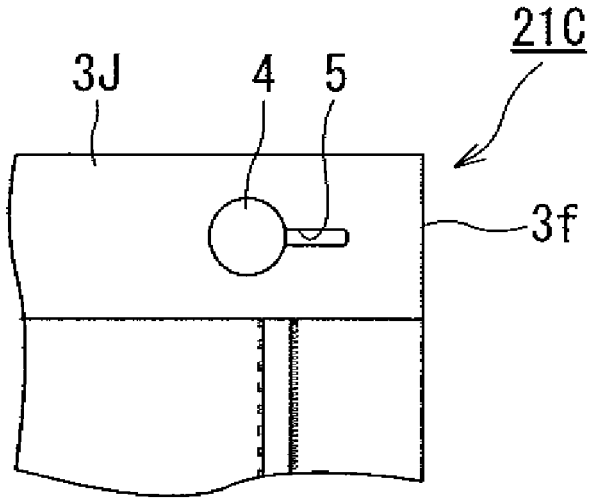
FIG. 21*b* is a drawing showing the button taken out of a second buttonhole in the garment having the waist size adjusting mechanism according to the fifth embodiment of the invention.

FIGS. 17*a*, 17*b* and 17*c* are drawings showing a fabricating method of a moving cloth unit of an inside belt portion, seen from a rear side, according to a fifth embodiment of the invention. FIG. 18*a* is a drawing showing a method of mounting a run-off (blow-out) prevention tape of the garment having the waist size adjusting mechanism according to the fifth embodiment of the invention. FIGS. 18*b* and 18*c* are drawings showing modified examples of run-off prevention tapes, respectively. FIG. 19*a* is a drawing showing a moving cloth unit attached to the inside belt portion, while illustrating the inside belt portion in an expansion plan view from a rear side, in the garment having the waist size adjusting mechanism according to the fifth embodiment of the invention. FIG. 19*b* is a drawing showing a height of a neck-wrapping or base-winding of a button in the garment having the waist size adjusting mechanism according to the fifth embodiment of the invention. FIG. 20*a* is a drawing showing a relation of the moving cloth unit and the run-off prevention tape, while illustrating the inside belt portion in an expansion plan view from a rear side with the moving cloth unit partially detached, in the garment having the waist size adjusting mechanism according to the fifth embodiment of the invention. FIG. 20*b* is a drawing showing the moving cloth unit with the button moved against a tension of an elastic material up to a full length of an expansion-preventing member, while illustrating the inside belt portion in an expansion plan view from the rear side. FIG. 20*c* is a perspective view of FIG. 20*b*. FIG. 21*a* is a drawing showing the run-off prevention tape stitched to the inside belt portion, while illustrating the inside belt portion in an expansion plan view from a rear side, in the garment having the waist size adjusting mechanism according to the fifth embodiment of the invention. FIG. 21*b* is a drawing showing the button taken out of a second buttonhole in the garment having the waist size adjusting mechanism according to the fifth embodiment of the invention.

As shown in FIG. 17*b*, a moving cloth 28, 29 is prepared by sticking and joining a reinforcing thin and stiff padding 29 on a tape cloth 28 to be a center of a moving cloth unit 25. Here, a lining cloth or a backing fabric having a color similar to that of a front fabric of the garment having the waist size adjusting mechanism is used as each of an expansion-preventing or stretching-preventing material 27 and the tape cloth 28 shown in FIG. 17*a*. An upper side (upper edge) and a lower side (lower edge) of the expansion-preventing material 27 is trimmed by overlooking. An upper side (upper edge) and a lower side (lower edge) of the tape cloth 28 is also trimmed by overlooking. Next, as shown in FIG. 17*a*, an Operon Rubber 26, the expansion-preventing material 27 and the tape cloth 28 are overlapped with each other. Then, one side edge parts (left side edge parts in FIG. 17) of the overlapped sheet of the Operon Rubber 26 and the expansion-preventing material 27 are temporarily jointed or fixed by a sewing machine stitch 26*a*. On the other hand, the Operon Rubber 26 and the expansion-preventing material 27 are covered with a seam allowance of the tape cloth 28 at the other side (right side in FIG. 17). Then, a seam allowance of the tape cloth 28 is sewn by two lines of stitches 28*a* at the other side edge part (right side edge part).

Next, as shown in FIG. 17*b*, a circumference of the reinforcing thin and stiff padding 29 is held by a sewing machine stitch 29*a* and prevented from peeling off. Then, as shown in FIG. 17*c*, two horizontal run-off (blow-off) prevention tapes 32 of 5 cm long are set and provided on the tape cloth 28. Thereafter, the run-off prevention tapes 32 are sewn and strongly secured on the tape cloth 28 by sewing machine stitches 32*a* at a position 1 cm inside from a left edge of the run-off prevention tape 32. At this stage, stitches 32*b* are not provided at a position 1 cm inside from a right edge of the run-off prevention tape 32, though they are illustrated for convenience sake in FIG. 17*c*.

Next, as shown in FIG. 18*a*, a vertical run-off (blow-off) prevention tape 31 is sewn on an inside belt portion 3J by four sewing machine stitches 31*a* that are provided so as to allow the two run-off prevention tapes 32 (provided later) to pass through an inside of the vertical run-off tape 31 between the adjacent two or a pair of the stitched 31*a*. As a modified example, only one horizontal run-off prevention tape 32 may be provided so as to pass through the vertical run-off prevention tape 31 between a pair of stitches 31*a*, as shown in FIG. 18*b*. Alternatively, three horizontal run-off prevention tapes 32 may be provided so as to pass through the vertical run-off prevention tape 31 between adjacent three pairs of the stitches 31*a*, respectively, as shown in FIG. 18*c*.

Next, as shown in FIG. 19*a*, the moving cloth unit 25 shown in FIG. 17*c* is provided and set on the inside belt portion 3J. Then, the left side edge parts of the Operon Rubber 26 and the expansion-preventing material 27 are fastened by two stitches 26*b*. Moreover, the button 4 is stitched on a predetermined position of the moving cloth unit 25. As shown in FIG. 19*b*, a base winding or a neck wrapping 4*a* of the button 4 is 0.3 cm to 0.5 cm in length so as to facilitate a movement in a horizontal or longitudinal direction (right and left direction) in the second buttonhole (eyelet buttonhole) 5. Moreover, the round part 5*a* of the second buttonhole (eyelet buttonhole) 5 is set or located just at a position corresponding to nearly a center of the moving cloth unit 25 when it returns to an original position by the elastic force of the elastic material 26.

Next, as shown in FIG. 20*a*, the two horizontal run-off prevention tapes 32, right edge parts of which are not yet fastened at this stage, are passed through the inside of the vertical run-off prevention tape 31. FIG. 20*b* is a drawing illustrating a state in which the Operon Rubber 26 is stretched to a full length of the expansion-preventing material 27. Such state is shown by a perspective view in FIG. 20*c*. Then, as shown in FIG. 21*a*, the right edge parts of the two horizontal run-off prevention tapes 32 are sewn and fastened by the stitches 32*b* at the position 1 cm inside from the right edge of the horizontal run-off prevention tapes 32. Next, the waistband cloth (inside belt portion) 3J is sewn on a main panel 17 (see FIGS. 13 to 15) of the garment having the waist size adjusting mechanism. Then, as shown in FIG. 21*b*, the button 4 sewn the moving cloth 28, 29 is protruded or taken out to the outside from the second buttonhole 5. Thereafter, an inner fold edge belt cloth 3*e* is sewn. Thus, the present embodiment of the moving cloth unit 25 is completed to be furnished on the garment or the ladies' pants 1.

With the garment having the waist size adjusting mechanism as constructed above, even if a tension is applied to the button 4, the two horizontal run-off prevention tapes 32 and the vertical run-off prevention tape 31 prevent in combination the moving cloth 28, 29 with the button 4 stitched from running off or being protruded outside the second buttonhole 5 (so-called run-off or blow-out phenomenon). In addition, a material of the vertical run-off prevention tape 31 and the horizontal run-of prevention tapes 32 is preferably composed of a single-sided satin tape, since it has a low friction surface and is slippery, while being durable.

As described above, the ladies' pants 1F as the garment having the waist size adjusting mechanism according to the fifth embodiment has the same appearance as the ordinary garment or normal ladies' pants. Moreover, the ladies' pants 1F can continuously change the waist size. Furthermore, the fastener tape moves in accordance with a change of the waist size, so that there are no wrinkles generated around the waist. In addition, even if the tension is applied to the button 4, the moving cloth 28, 29 with the button 4 stitched can be surely prevented from being protruded outside or running off from the second buttonhole 5 (so-called blow out phenomenon). Moreover, the ladies' pants 1F makes it possible to reattach the button 4 more easily and more durably when the button 4 comes off or is detached.

Each of the above embodiments is described on the case in which the garment having the waist size adjusting mechanism of the invention is concretized in the ladies' pants. However, the garment having the waist size adjusting mechanism of the invention may be embodied into an overall garment and also applicable to gentleman's pants, jeans, cotton trousers, a skirt, culottes, a dress or one-piece suite, or the like.

In the above-mentioned embodiments, the Operon Rubber is used as the elastic material while being cut into a predetermined size. However, other type of rubber tapes or the like may be used.

Each of the above-mentioned embodiments is described as an example in which the tuck is provided on the outer fold of the trousers or the like on which the fastener tape is stitched so that the fastener tape is allowed to move in accordance with a change of the waist size. However, the inventive pants are not always limited to the embodiment having a structure that allows the fastener tape to move in accordance with the change of the waist size.

The invention is not limited to those of the above-mentioned embodiments with respect to the structures of other parts, the shape, the number or amount, the material, the dimension, the configuration of connection and the like in the garment having the waist size adjusting mechanism.

While this invention has been described in detail in several preferred embodiments, it will be understood that numerous additions, deletions and modifications may be readily made thereto without departure from the spirit and scope of the invention as set forth in the following claims.

The invention claimed is:

1. A garment having a waist size adjusting mechanism, comprising:

a moving cloth of a predetermined length attached to an inside belt portion of the garment via an elastic material so as to be movable along a waistband;

a button stitched on the moving cloth with a predetermined length of a thread base or a neck-wrapping;

a first buttonhole provided on an outside belt portion of the garment, and a second buttonhole provided on a front fabric of the inside belt portion of the garment, the button being passed through the second buttonhole from a rear side to a front side, the button being movable in accordance with the moving cloth as the moving cloth moves along the waistband against an elastic force of the elastic material, wherein the second buttonhole is an eyelet buttonhole having a round part provided at one longitudinal end of a straight part, away from an outer fold of the garment, the round part of the eyelet buttonhole being located at a position corresponding to nearly a center of the moving cloth when the moving cloth returns to an original position by the elastic force of the elastic material, wherein said inside belt portion includes a folded back portion which is folded at a return line to cover at least said eyelet buttonhole, said return line being perpendicular to a longitudinal direction of said inside belt portion, and wherein said garment further comprises an expansion preventing material attached on a first end to said inside belt portion at a first position of said inside belt portion and on a second end to said inside belt portion at a second position, said expansion preventing material traversing said return line and said eyelet buttonhole.

2. A garment having a waist size adjusting mechanism according to claim 1, further comprising an inside belt facing of the garment having a stitched round hole or a ring hole as a through hole provided at a position corresponding to the round part of the eyelet buttonhole, wherein the stitched round hole or the ring hole is provided only at a position corresponding to the round part of the eyelet buttonhole.

3. A garment having a waist size adjusting mechanism according to claim 1, wherein moving cloth includes a fabric of a predetermined size and a thin and stiff padding of generally a same size as the fabric, wherein the fabric and the thin and stiff padding are (i) stuck to each other, (ii) sewn together at circumferences thereof, or (iii) stuck together and are sewn together at circumferences thereof.

4. A garment having a waist size adjusting mechanism according to claim 1, in which the expansion-preventing material is stitched and joined to the elastic material and the moving cloth and protruded from the moving cloth so as to be stitched to an inside belt facing of the garment, and the expansion-preventing material has a full length of longitudinal opposite edges sewn by overlocking.

5. A garment having a waist size adjusting mechanism according to claim 1, further comprising a vertical tape and one or more horizontal run-off prevention tapes that serve in combination to prevent the moving cloth from swinging in a vertical direction and from running off from the second buttonhole, the vertical tape having opposite ends stitched to the inside belt portion, the horizontal tape being passed under the vertical tape so as to be movable in a horizontal direction and stitched to a rear side of the moving cloth.

6. A garment having a waist size adjusting mechanism according to claim 1, further comprising a horizontal tape and one or more vertical run-off prevention tapes that serve in combination to prevent the moving cloth from swinging in a vertical direction and from running off from the second buttonhole, the horizontal tape having opposite ends stitched to the inside belt portion at a position corresponding to the buttonhole provided on the outside belt portion, the vertical run-off prevention tape being passed under the horizontal tape so as to be movable in a horizontal direction and stitched to a rear side of the moving cloth.

7. A garment having a waist size adjusting mechanism according to claim 1, further comprising a hook structure and an eyelet structure used in combination, the hook structure and the eyelet structure being attached to the outside belt portion and a rear side of the inside belt portion of the garment, respectively, and vice versa.

8. A garment having a waist size adjusting mechanism according to claim 1, in which the moving cloth and the expansion-preventing material are each composed of a lining cloth having a color similar to the front fabric of the belt portion.

9. A garment having a waist size adjusting mechanism according to claim 1, further comprising a reinforcing pad stuck to (i) a backside of the front fabric of the inside belt portion, (ii) a rear side of a facing portion of the inside belt portion, or (iii) the backside of the front fabric of the inside belt portion and the rear side of the facing portion of the inside belt portion, so that the reinforcing pad borders the round hole of the eyelet buttonhole.

* * * * *